US010632767B2

(12) United States Patent
Nampo

(10) Patent No.: US 10,632,767 B2
(45) Date of Patent: Apr. 28, 2020

(54) PRINTER

(71) Applicant: Brother Kogyo Kabushiki Kaisha, Nagoya-shi, Aichi-ken (JP)

(72) Inventor: Hiromichi Nampo, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/926,388

(22) Filed: Mar. 20, 2018

(65) Prior Publication Data

US 2019/0001703 A1 Jan. 3, 2019

(30) Foreign Application Priority Data

Jun. 28, 2017 (JP) ..... 2017-126662

(51) Int. Cl.

| | |
|---|---|
| ***B41J 2/355*** | (2006.01) |
| ***B41J 15/06*** | (2006.01) |
| ***B41J 11/42*** | (2006.01) |
| ***B41J 19/20*** | (2006.01) |
| ***B41J 15/04*** | (2006.01) |

(52) U.S. Cl.

CPC ..... *B41J 11/425* (2013.01); *B41J 2/3555* (2013.01); *B41J 11/42* (2013.01); *B41J 15/042* (2013.01); *B41J 15/06* (2013.01); *B41J 19/205* (2013.01)

(58) Field of Classification Search

CPC . B41J 2/3555; B41J 2/365; B41J 15/06; B41J 11/425

See application file for complete search history.

(56) References Cited

U.S. PATENT DOCUMENTS 5,741,079 A * 4/1998 Hayama ..... B41J 2/365 347/191
2017/0028741 A1* 2/2017 Tatsuta ..... B41J 2/3556
2018/0207952 A1* 7/2018 Hattori ..... B41J 2/325

FOREIGN PATENT DOCUMENTS

JP 2009-078385 A 4/2009

* cited by examiner

*Primary Examiner* — Alessandro V Amari
*Assistant Examiner* — Kendrick X Liu
(74) *Attorney, Agent, or Firm* — Banner & Witcoff, Ltd.

(57) ABSTRACT

The disclosure discloses a printer includes a controller. The controller performs a first feed control process, a temperature-difference calculation process, and a first printing speed determination process. In the first feed control process, in a state where an energizing device does not perform energization to the heating element, the driving device is controlled to perform non-energization feeding while causing a thermal head to contact a print-receiving medium. In the temperature-difference calculation process, during execution of the non-energization feeding, a first deviation between two of the head temperatures which are respectively detected by the first temperature detecting device at different timings is calculated. In the first printing speed determination process, the printing speed is determined on the basis of the first deviation.

6 Claims, 14 Drawing Sheets

[FIG. 1]
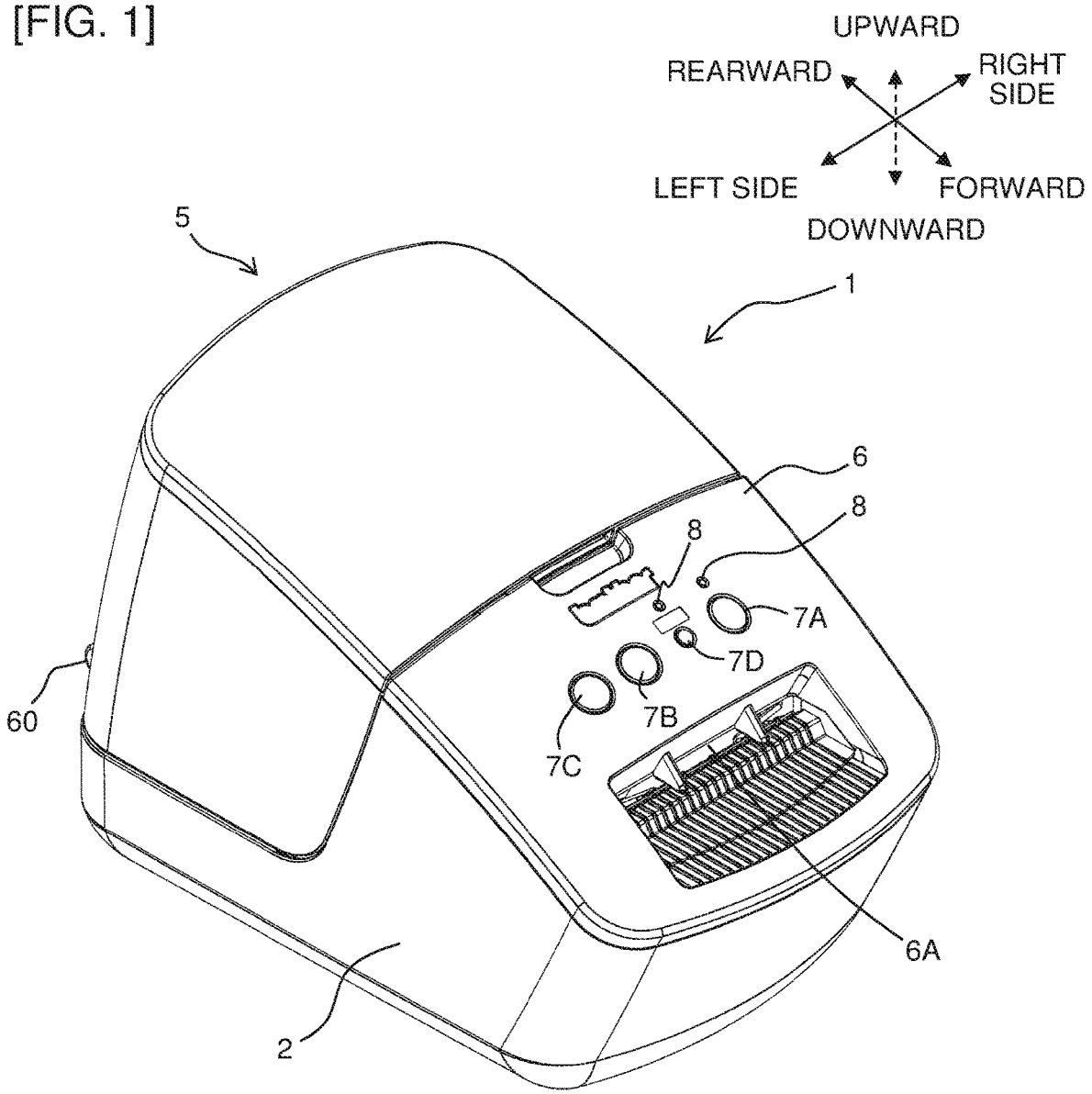

[FIG. 2]
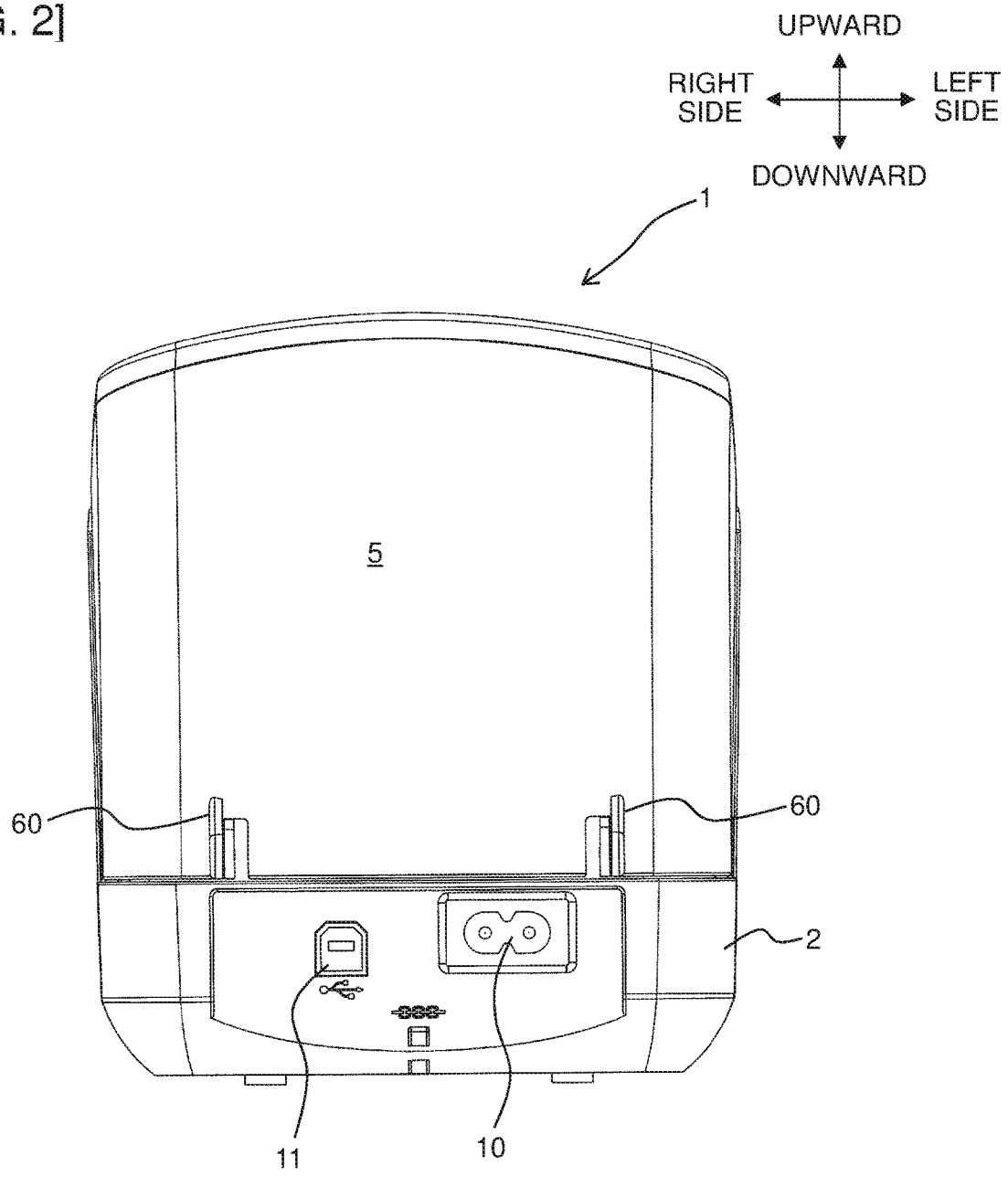

[FIG. 3]
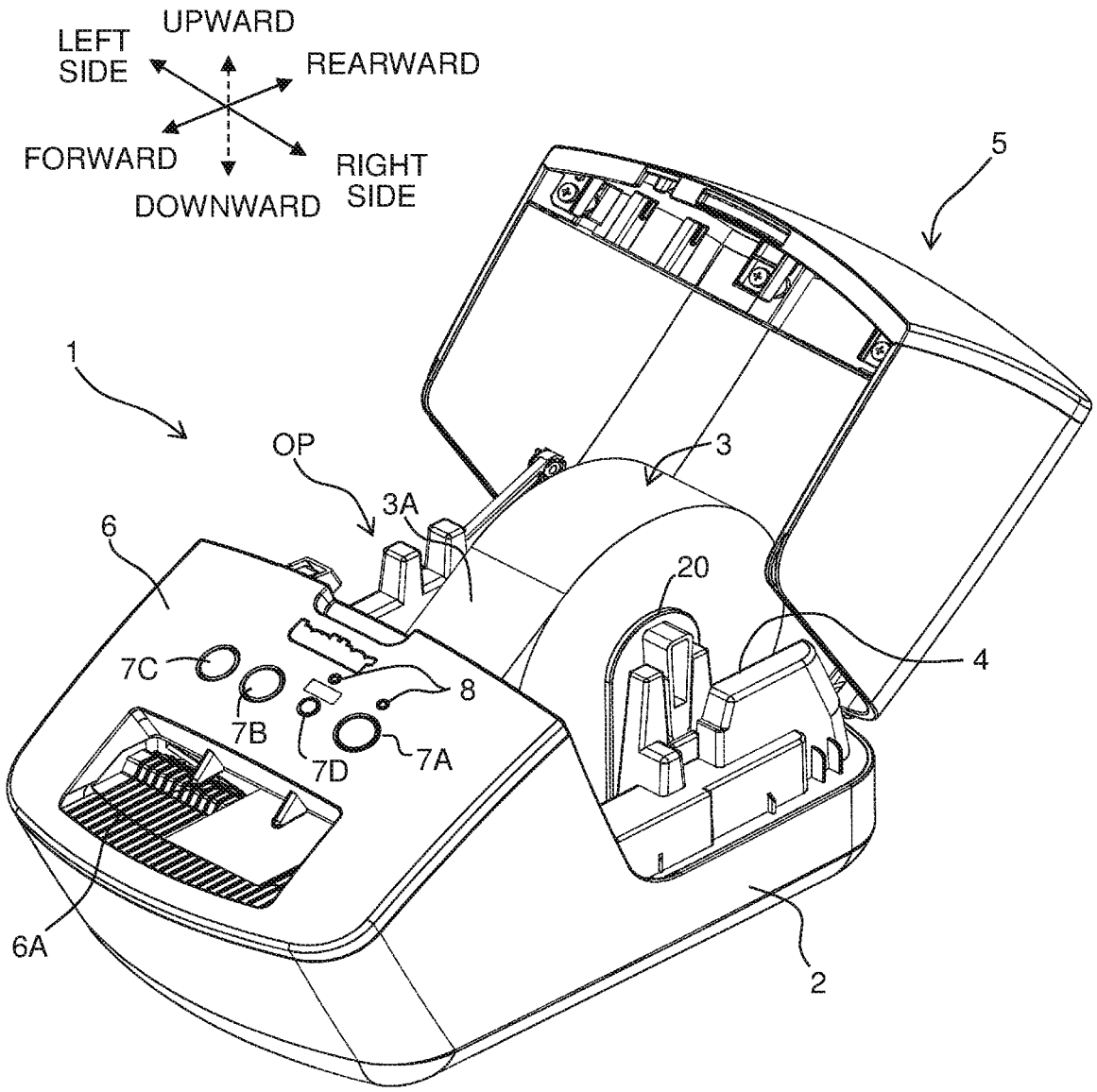

[FIG. 4]
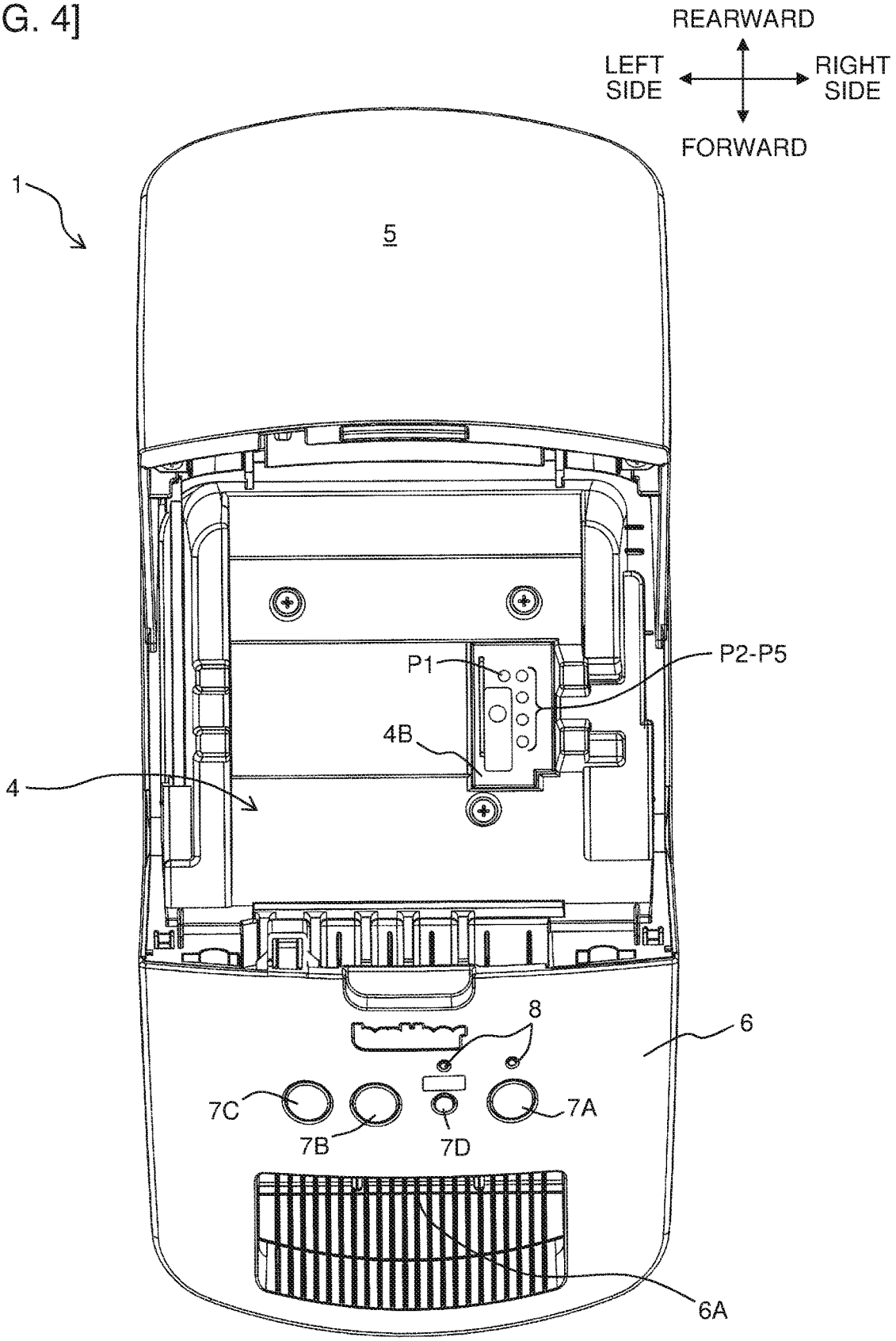

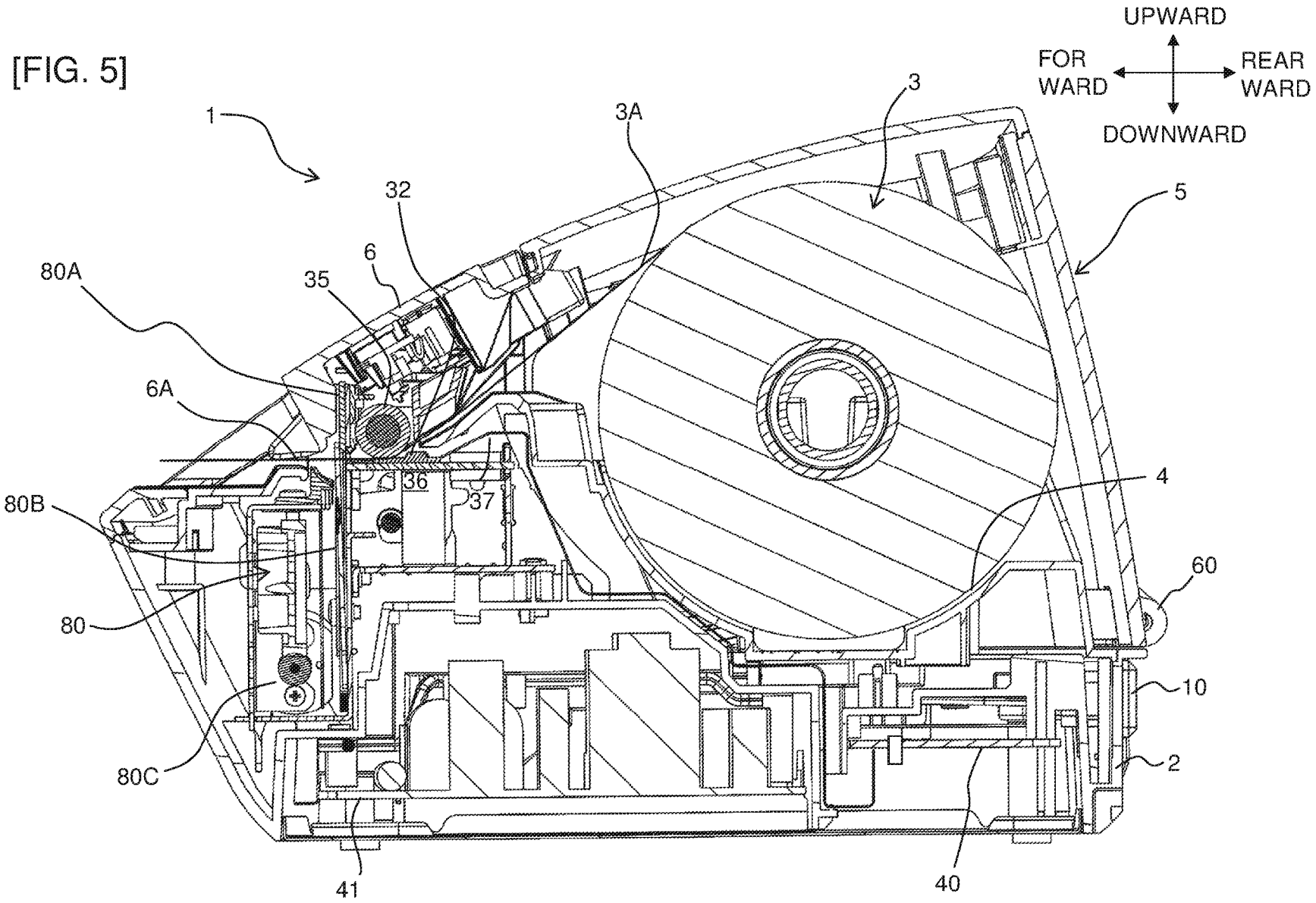
[FIG. 5]

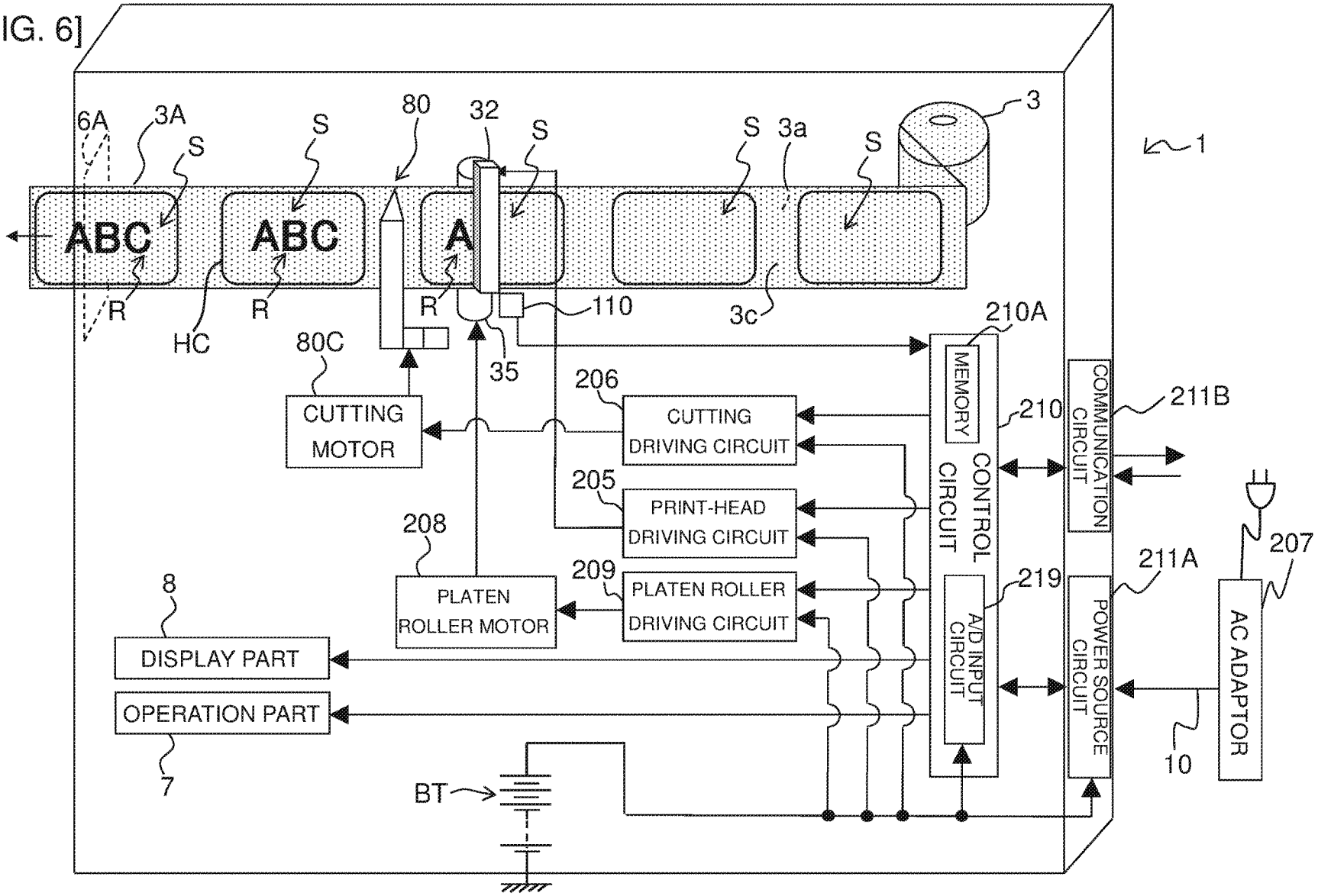
[FIG. 6]

[FIG. 7A]
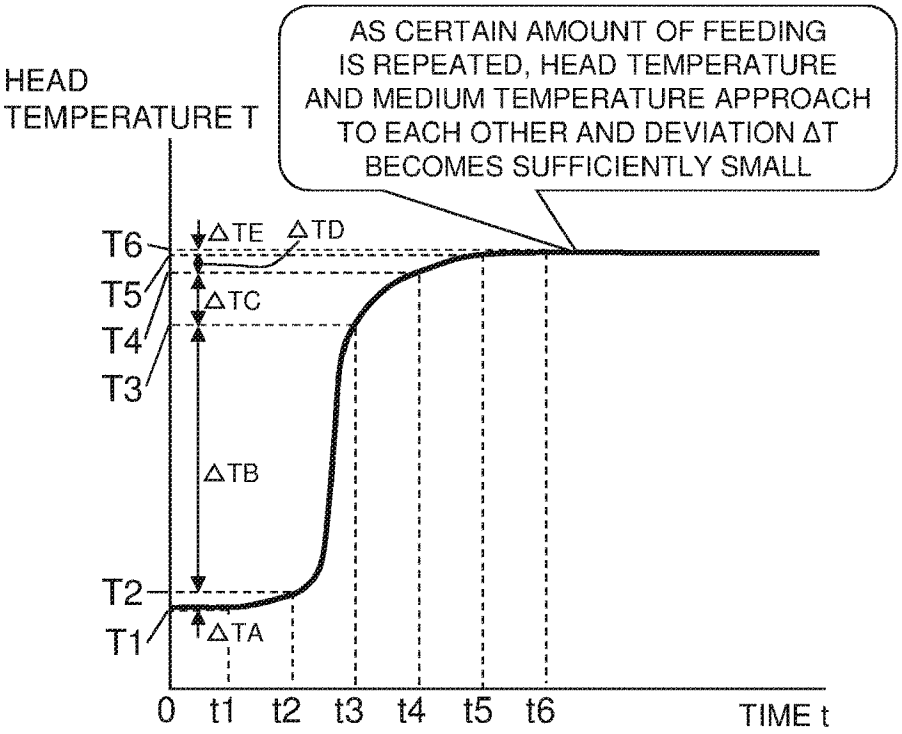
[FIG. 7B]
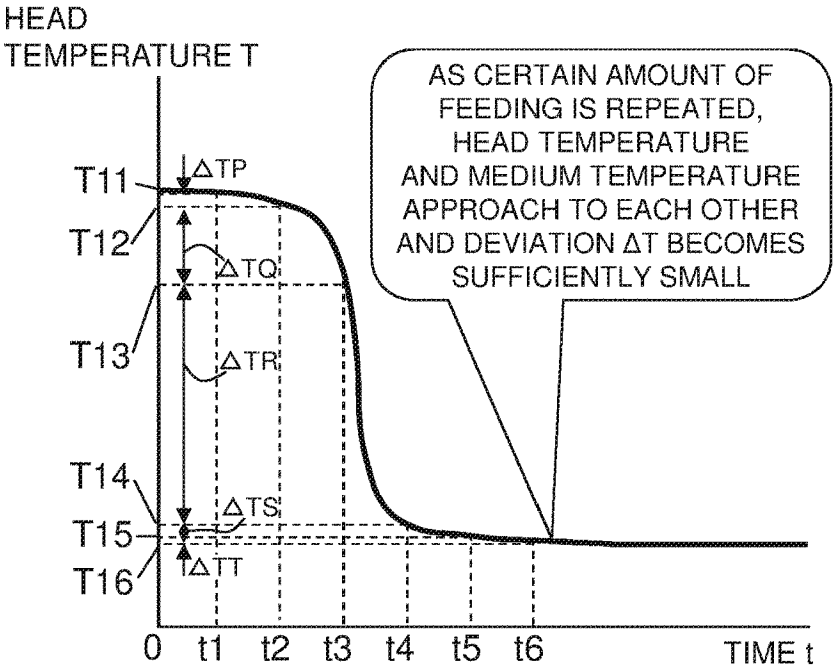

[FIG. 8]
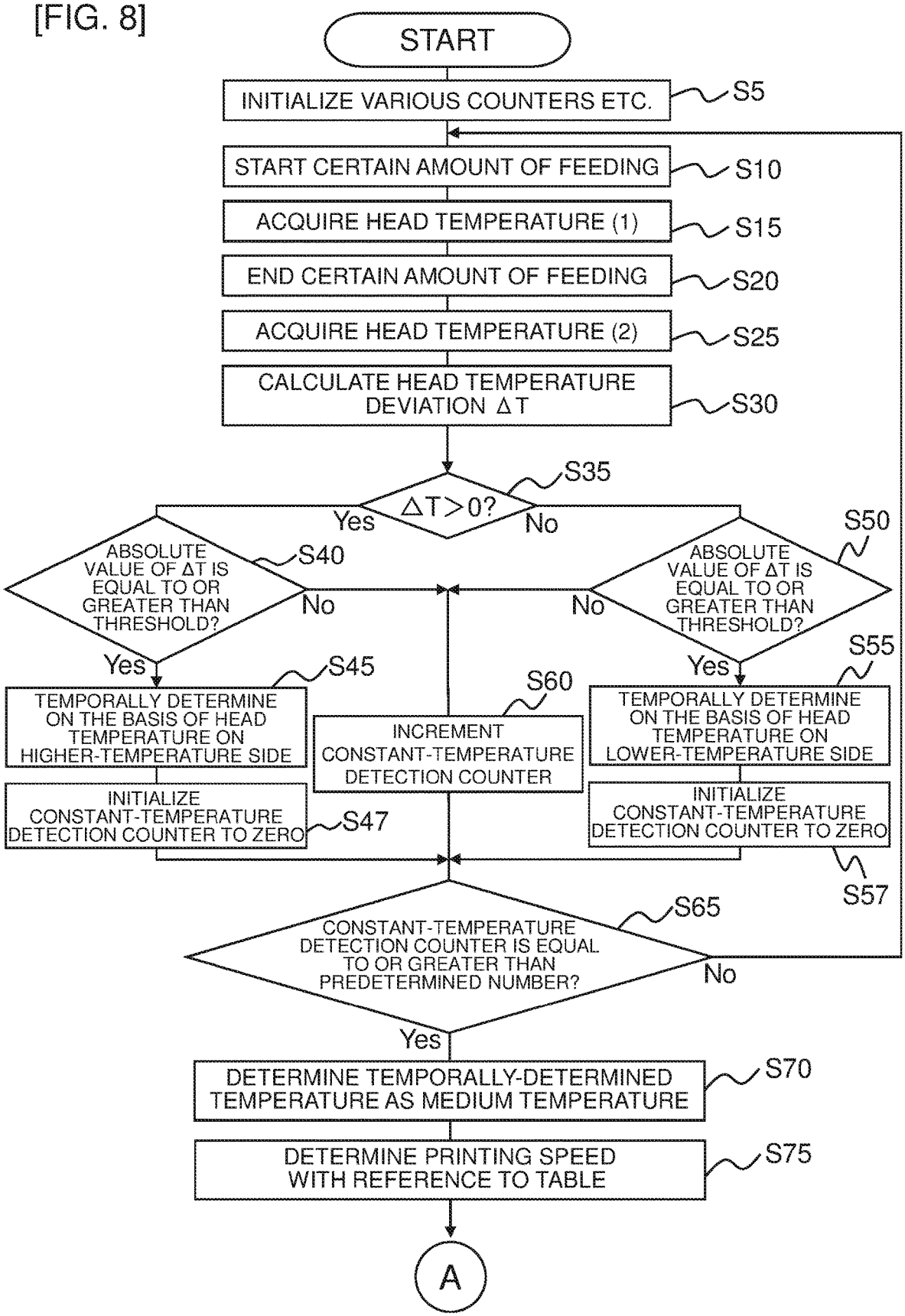

[FIG. 9]

| MEDIUM TEMPERATURE | PRINTING SPEED |
|---|---|
| LESS THAN 12℃ | Va |
| EQUAL TO OR GREATER THAN 12℃ AND LESS THAN 17℃ | Vb |
| EQUAL TO OR GREATER THAN 17℃ AND LESS THAN 22℃ | Vc |
| EQUAL TO OR GREATER THAN 22℃ AND LESS THAN 27℃ | Vd |
| EQUAL TO OR GREATER THAN 27℃ AND LESS THAN 32℃ | Ve |
| EQUAL TO OR GREATER THAN 32℃ AND LESS THAN 37℃ | Vf |
| EQUAL TO OR GREATER THAN 37℃ AND LESS THAN 42℃ | Vg |
| EQUAL TO OR GREATER THAN 42℃ | Vh |

※ WHERE Va<Vb<Vc<Vd<Ve<Vf<Vg<Vh, e.g., ON THE ORDER OF Vb≅85[mm/sec], Vc≅96[mm/sec]

[FIG. 10]
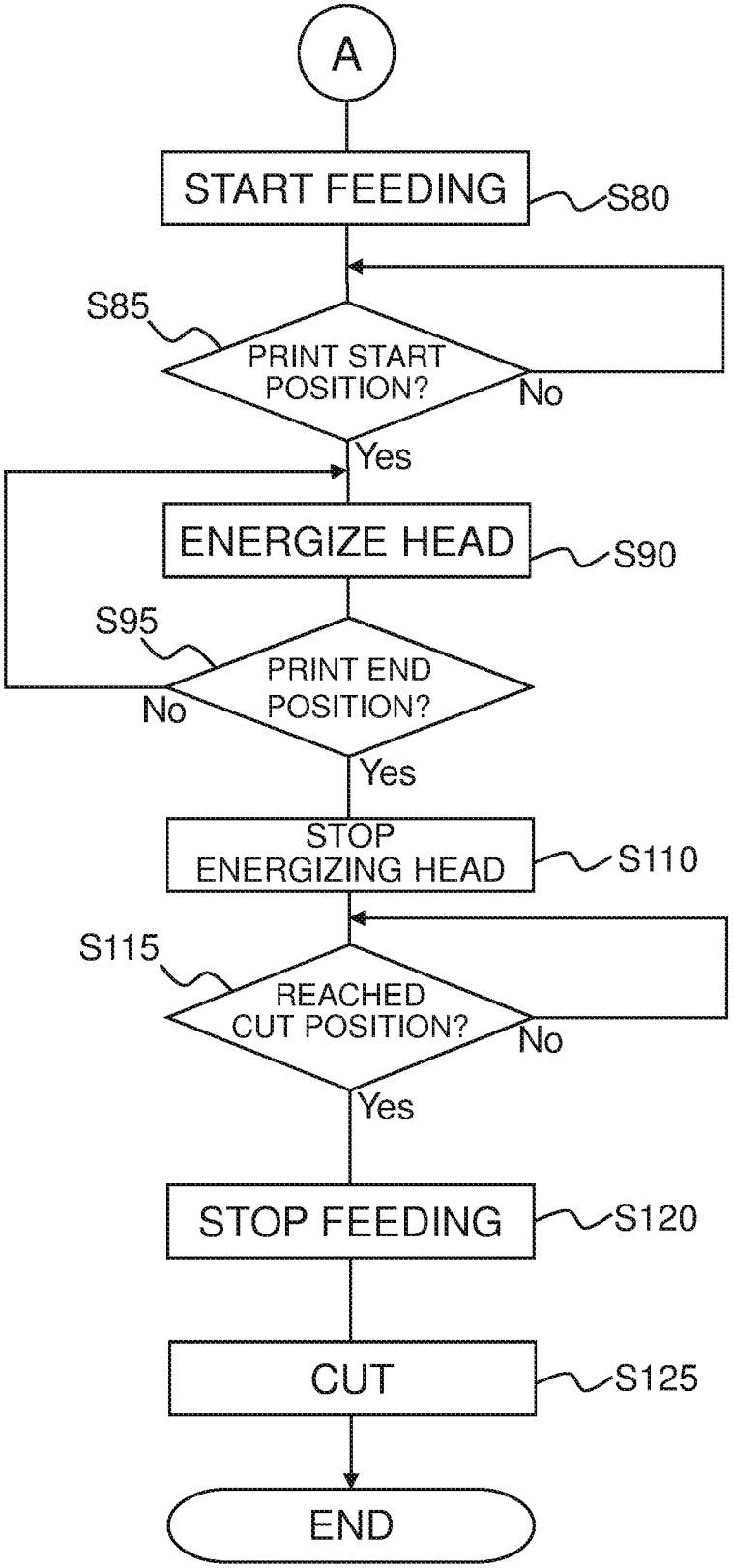

[FIG. 11A]
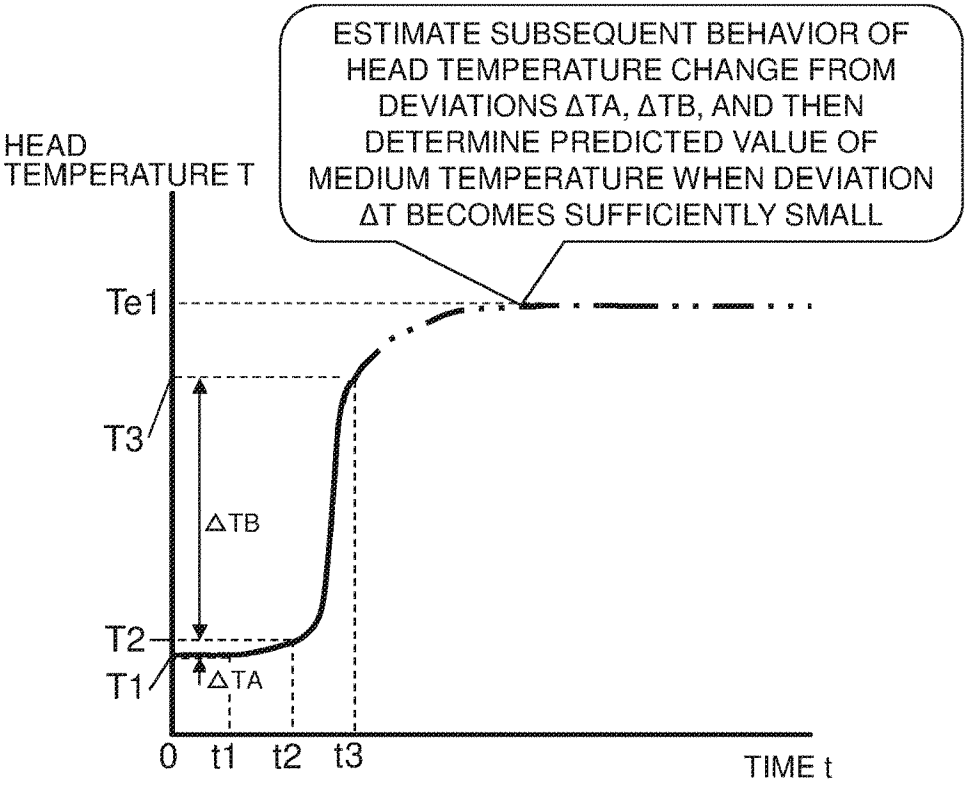
[FIG. 11B]
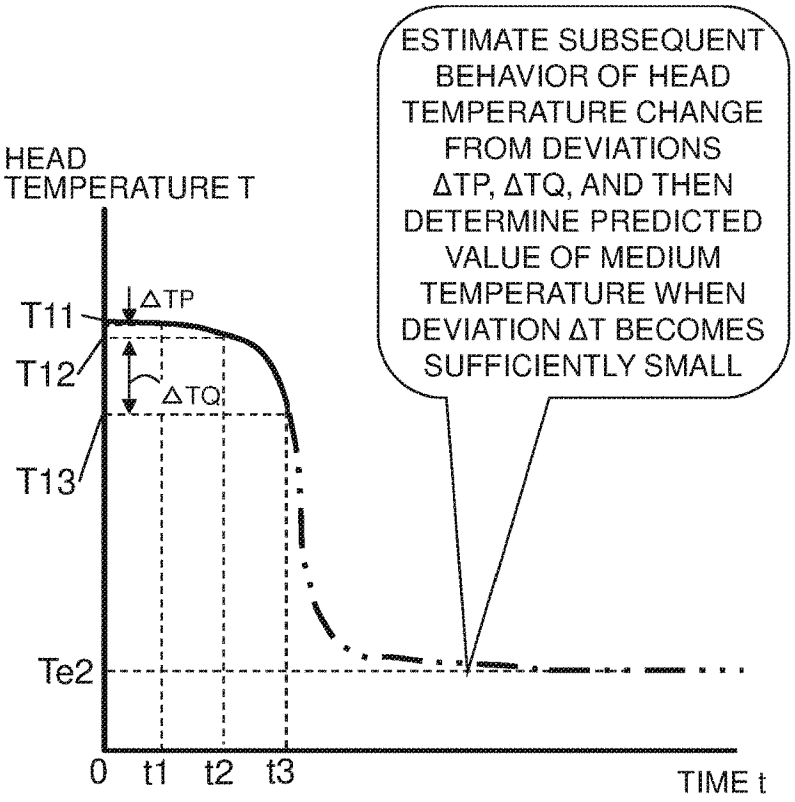

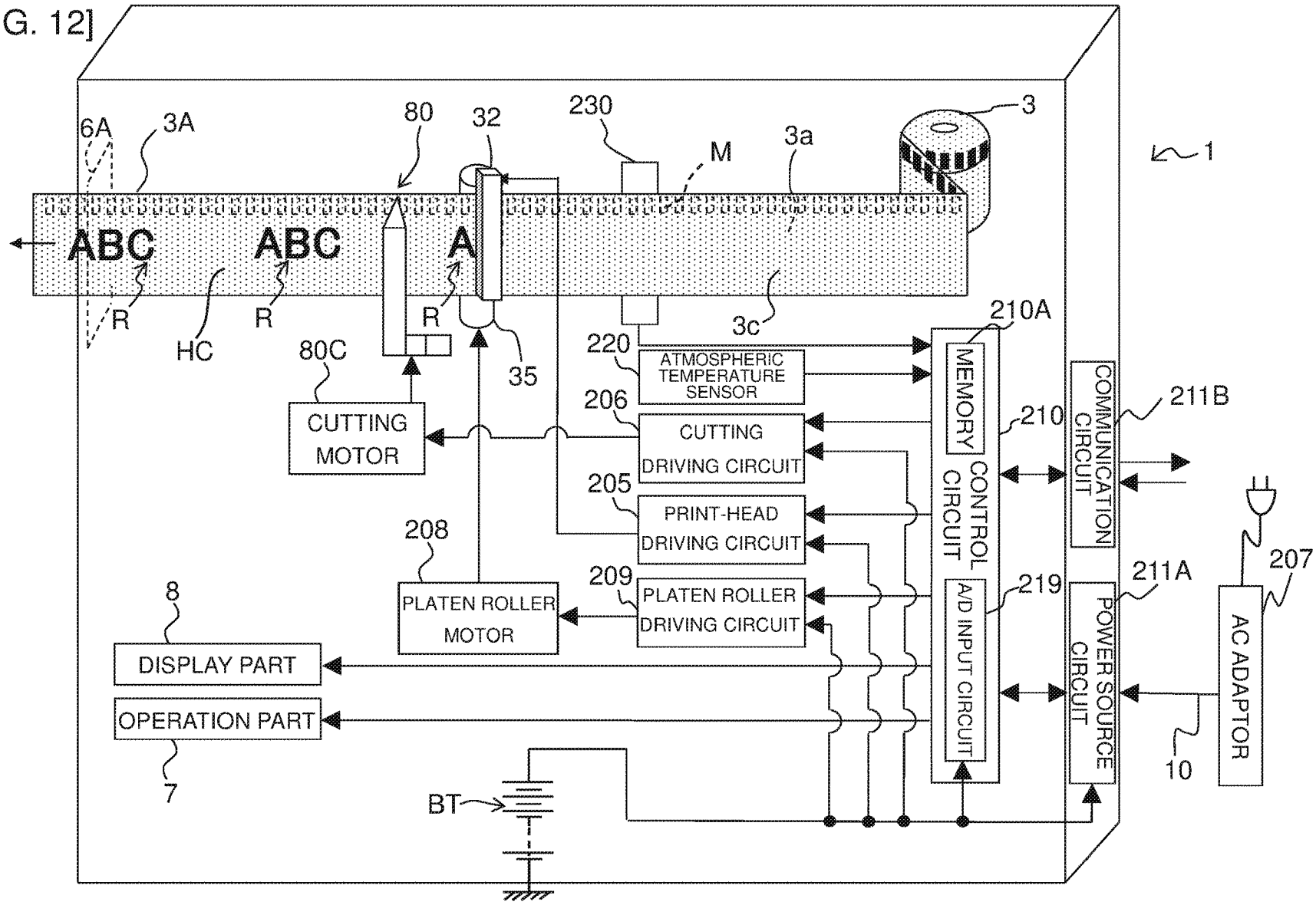
[FIG. 12]

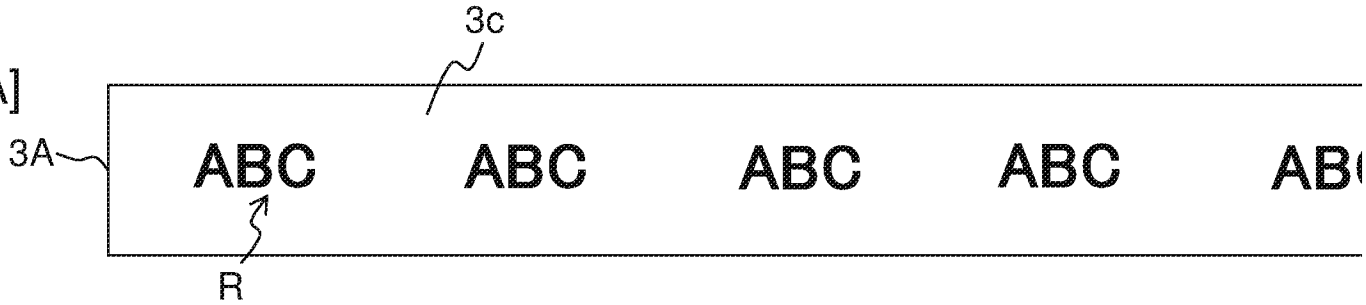
[FIG. 13A]
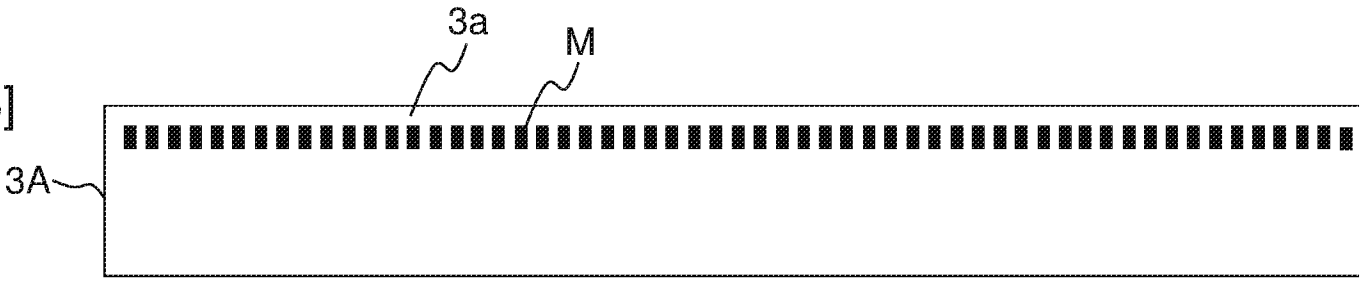
[FIG. 13B]

[FIG. 14]
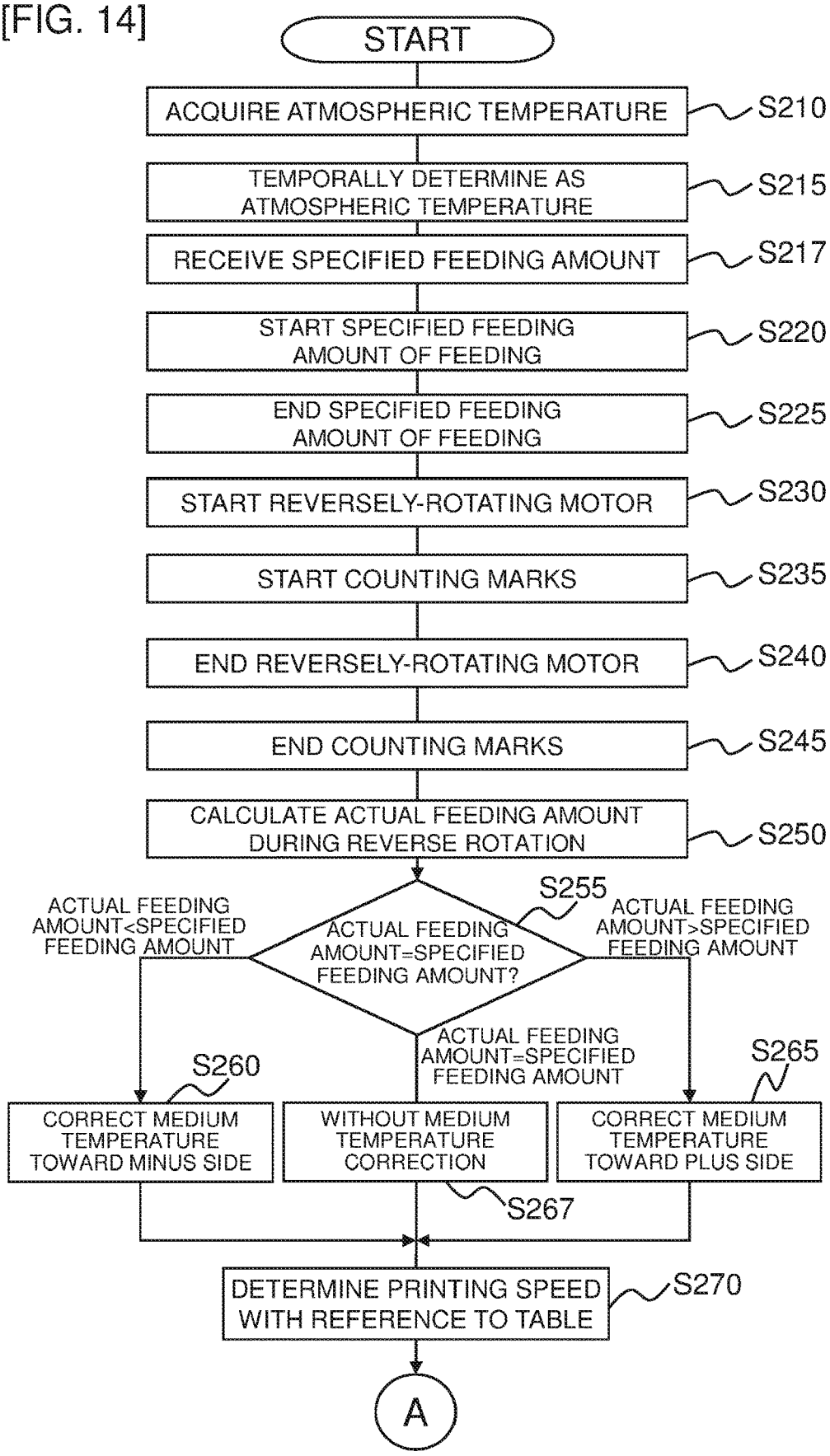

PRINTER

CROSS-REFERENCE TO RELATED APPLICATION

The present application claims priority from Japanese Patent Application No. 2017-126662, which was filed on Jun. 28, 2017, the disclosure of which is incorporated herein by reference in its entirety.

BACKGROUND

Field

The present disclosure relates to a printer for forming a desired print on a print-receiving medium.

Description of the Related Art

There is known a printer for forming a desired print on a print-receiving medium. In this printer, the print-receiving medium (image receiving paper) is fed by a platen roller, and with a heating element (heating resistor) of a thermal head to be energized, a print is formed on the fed print-receiving medium. At this time, printing is performed at a desired printing speed, in a state where the feeding by the platen roller is in synchronization with the print formation by the thermal head.

Here, in a case where a printer and/or a print-receiving medium is used in various temperature environments, the above described printing speed is affected by the temperature thereof. For example, in a case where a print-receiving medium is at a relatively low temperature, the feeding resistance will increase, so it is necessary to set the printing speed to be relatively low. In contrast, in a case where a print-receiving medium is at a relatively high temperature, the feeding resistance will decrease, so it is possible to set the printing speed to be relatively high. However, once a print-receiving medium is set on a printer, it is difficult on the printer side to accurately detect the temperature of the print-receiving medium, so it is difficult to precisely and appropriately determine the printing speed. In the above described prior art, although a technique for detecting the ambient temperature and/or the temperature of a thermal head is disclosed, the detection of the temperature of a media to be printed as described above is not particularly taken into consideration.

SUMMARY

The object of the present disclosure is to provide a printer capable of setting an appropriate printing speed in accordance with the temperature of a print-receiving medium.

In order to achieve the above-described object, according the first aspect of the present application, there is provided a printer comprising a feeder configured to feed a print-receiving medium at a desired feeding speed, a thermal head including a plurality of heating elements, an energizing device configured to energize the plurality of heating elements, a driving device configured to drive the feeder, a first temperature detecting device disposed on the thermal head and configured to detect a head temperature of the thermal head, and a controller, the controller performing a coordination control process for coordinating and controlling the energizing device and the driving device and for forming a print onto the print-receiving medium by the thermal head at a printing speed synchronized with the feeding speed, a first feed control process for, in a state where the energizing device does not perform energization to the heating element, controlling the driving device to perform non-energization feeding while causing the thermal head to contact the print-receiving medium, a temperature-difference calculation process for calculating, during execution of the non-energization feeding in the first feed control process, a first deviation between two of the head temperatures which are respectively detected by the first temperature detecting device at different timings, and a first printing speed determination process for determining the printing speed on the basis of the first deviation calculated in the temperature-difference calculation process.

In the first aspect of the present disclosure, a print-receiving medium is fed by a feeder driven by a driving device, and with a heating element of a thermal head energized by an energizing device, a print is formed on the fed print-receiving medium. At this time, the above described driving device and energizing device are coordinated and controlled in a coordination control process performed by a controller, so that printing is performed at a desired printing speed, in a state where the feeding by the feeder is in synchronization with the print formation by the thermal head.

Then, in the printer according to the first disclosure, a first temperature detecting device is disposed, and a first feed control process and a temperature-difference calculation process are performed by the controller. By controlling the driving device in the first feed control process, feeding is performed without energization of the above described heating element (this is referred to as "non-energization feeding"). In this non-energization feeding, the thermal head is in contact with the print-receiving medium, and due to heat conduction, the temperature of the thermal head (head temperature) will approach, with time, the temperature of the print-receiving medium. In response to this, a first temperature detecting device detects the above described head temperature at each of two different timings during the above described non-energization feeding, and the deviation (a first deviation) therebetween is calculated in the temperature-difference calculation process. Then, on the basis of this deviation, the above described printing speed is determined in a first printing speed determination process. Thus, for example, when the above described deviation becomes sufficiently small and the head temperature to be detected becomes substantially equal to the temperature of the print-receiving medium, the printing speed can be appropriately determined in accordance with the temperature. Alternatively, for example, a behavior of the head temperature change is estimated on the basis of the above described deviation, and in accordance with a predicted value of the medium temperature when the above described deviation becomes sufficiently small, the printing speed can be appropriately determined. As the result, unlike the prior art which does not particularly take into consideration the temperature of a print-receiving medium, it is possible to respond to a change in the feeding resistance of a print-receiving medium due to a change in temperature and to precisely set an appropriate printing speed. Moreover, in this case, disposing of one first temperature detecting device is sufficient as a detecting device, so the cost will not be increased.

Further, in order to achieve the above-described object, according the second aspect of the present application, there is provided a printer comprising a feeder configured to feed a print-receiving medium at a desired feeding speed, a thermal head including a plurality of heating elements, an energizing device configured to energize the plurality of heating elements, a driving device configured to drive the feeder, and a controller, the controller performing a coordination control process for coordinating and controlling the energizing device and the driving device and for forming a print onto the print-receiving medium at a printing speed synchronized with the feeding speed, an instruction receiving process for receiving an input of a predetermined specified feeding amount, a second feed control process for controlling the driving device to perform a feeding of the print-receiving medium by the specified feeding amount received in the instruction receiving process, a feeding amount detection process for detecting an actual feeding amount of the print-receiving medium, the actual feeding amount being fed by the feeder by controlling the driving device in the second feed control process, and a second printing speed determination process for determining the printing speed on the basis of a second deviation between the actual feeding amount detected in the feeding amount detection process and the specified feeding amount.

In the second aspect of the present disclosure, an instruction receiving process, a second feed control process, and a feeding amount detection process are performed by the controller. An operator specifies a desired feeding amount (specified feeding amount), and an instruction input thereof is received in an instruction receiving process, and by controlling the driving device in the second feed control process, the feeding of a print-receiving medium corresponding to the above described specified feeding amount is performed. Then, an actual feeding amount at this time is detected in the feeding amount detection process.

In the printer according to the second disclosure, the above described printing speed is determined in a second printing speed determination process on the basis of a deviation (a second deviation) of the above described actual feeding amount from the specified feeding amount. Thus, an appropriate printing speed corresponding to the temperature of a print-receiving medium can be determined.

BRIEF DESCRIPTION OF THE DRAWING

FIG. 1 is a perspective view illustrating the appearance of a print label producing apparatus according to a first embodiment of the present disclosure.

FIG. 2 is a rear view of the print label producing apparatus.

FIG. 3 is a perspective view illustrating a state where a roll is mounted on the print label producing apparatus while an opening/closing cover is opened.

FIG. 4 is a plan view illustrating a state where the opening/closing cover of the print label producing apparatus is opened.

FIG. 5 is a side sectional view illustrating a state where the roll is mounted on the print label producing apparatus.

FIG. 6 is a functional block diagram illustrating a control system of the print label producing apparatus.

FIG. 7A is an explanatory view illustrating an example of the behavior of head temperature change during non-energization feeding.

FIG. 7B is an explanatory view illustrating another example of the behavior of head temperature change during non-energization feeding.

FIG. 8 is a flow chart illustrating a control procedure performed by a CPU of a control circuit.

FIG. 9 is a table illustrating a correlation between a medium temperature and a printing speed.

FIG. 10 is a flow chart illustrating the control procedure performed by the CPU of the control circuit.

FIG. 11A is an explanatory view illustrating an example of the behavior of head temperature change during non-energization feeding, in a variant wherein the medium temperature is predicted on the basis of a reduced behavior of the deviation of the head temperature.

FIG. 11B is an explanatory view illustrating another example of the behavior of head temperature change during non-energization feeding, in a variant wherein the medium temperature is predicted on the basis of a reduced behavior of the deviation of the head temperature.

FIG. 12 is a functional block diagram illustrating a control system of a print label producing apparatus according to a second embodiment of the present disclosure.

FIG. 13A is a plan view illustrating the appearance on a thermal layer side of a roll sheet.

FIG. 13B is a plan view illustrating the appearance on a separation sheet side of the roll sheet.

FIG. 14 is a flow chart illustrating the control procedure performed by the CPU of the control circuit.

DETAILED DESCRIPTION OF THE PREFERRED EMBODIMENTS

Hereinafter, embodiments of the present disclosure will be explained with reference to the accompanying drawings.

A first embodiment of the present disclosure will be explained with reference to FIG. 1-FIG. 11. According to this embodiment, the present disclosure is applied to a print label producing apparatus 1 as a printer. First, a schematic configuration of the print label producing apparatus 1 according to this embodiment will be explained on the basis of FIG. 1-FIG. 4.

<Schematic Structure of Print Label Producing Apparatus>

As illustrated in FIG. 1, FIG. 2 and FIG. 3, the print label producing apparatus 1 includes a plastic housing 2 constituting the contour of this apparatus 1 and including a roll storage part 4 configured to store a roll 3, around which a roll sheet 3A of a desired width is wound; and an opening/closing cover 5 made from a transparent resin and mounted, in an openable and closable manner via a pair of left and right hinge parts 60 on the rear side, on an upper end edge on the rear side so as to cover the upper side of the roll storage part 4.

The roll sheet 3A includes a long-length sheet or the like, which includes a plurality of pages in a length direction, and is wound around the roll 3. Particularly, in this example, the roll sheet 3A is the so-called die cut tape, in which on one surface of a separation sheet 3*a* a plurality of label mounts S, each being separated into a predetermined size in advance with a thermal layer 3*c* having self-coloring properties, are continuously arranged while being spaced apart from each other in a length direction (see FIG. 6 described later).

The opening/closing cover 5 is supported by the housing 2 via the hinge part 60 so as to be turnable, and opens/closes an opening part OP above the roll storage part 4 by this turning.

A sheet discharging port 6A for discharging the roll sheet 3A with print to the outside is formed in the front cover 6 on the front side of the opening/closing cover 5. Moreover, in a front part on the upper side of this sheet discharging port 6A, a total of four buttons are arranged substantially in parallel: i.e., a power button 7A; a cut button 7B which, by being depressed, causes a cutter unit 80 (see FIG. 5 described later) disposed on the inner side of the sheet discharging port 6A to be driven, thereby cutting the roll sheet 3A and generating a print label (not illustrated); a feed button 7C which, while being depressed, causes the roll sheet 3A to be fed in a discharge direction (i.e., forward direction); and another button 7D (hereinafter, these are simply and generally referred to as an "operation part 7" as needed). Furthermore, a display part 8 including, for example, an LED is arranged in a vicinity of each of the power button 7A and control button 7D in the front cover 6.

Moreover, an inlet 10, to which a power source cord from an AC adapter 207 (see FIG. 6 described later) to be connected to an external power source is connected, is disposed to the back part of the housing 2, while on the lateral side thereof (left side in FIG. 2) a USB connector 11, to which a personal computer (not illustrated) or the like as an operation terminal is connected, is disposed.

<Details of Roll Storage Part>

As illustrated in the above described FIG. 3 and FIG. 4, a plane-view rectangular discriminating depression 4B which is vertically long in the feed direction is formed in a bottom face part of the roll storage part 4. This discriminating depression 4B faces a sheet discriminator (not illustrated) extended in an inward direction at substantially right angle from a lower end edge of a positioning holding member 20 for holding the roll 3.

Then, in this discriminating depression 4B, five sheet discriminating sensors P1, P2, P3, P4, and P5 for discriminating the type, quality of material, width and the like of the roll sheet 3A are disposed in an L shape in this example, the five sheet discriminating sensors each including a push-type microswitch and the like. Each of these sheet discriminating sensors P1-P5 includes a known mechanical switch including a plunger, a microswitch, and the like. An upper end of each plunger is disposed so as to protrude from a bottom face part of this discriminating depression 4B. Then, each of these sheet discriminating sensors P1-P5 detects whether or not there is each sensor hole (not illustrated) formed in the sheet discriminator extended in an inward direction at a substantially right angle from a lower end edge of the positioning holding member 20 with respect to these sensors P1-P5, and detects, with the ON/OFF signal of this detection, the type, quality of material, width and the like of the roll sheet 3A wound around the roll 3.

<Internal Mechanics Such as Thermal Head, Cutter Unit>

Then, as illustrated in FIG. 5, a platen roller 35 is rotatably journaled inside the housing 2. Moreover, a thermal head 32 is fixed to the upper face of a head support member 37 which is upwardly urged by a pressing spring 36.

Moreover, a cutter unit 80 is disposed to the downstream side in the feed direction (left side in FIG. 5) of the roll sheet 3A from the platen roller 35 and thermal head 32. This cutter unit 80 includes a stationary blade 80A and a movable blade 80B as illustrated in FIG. 5. In the case that the above described cut button 7B is depressed, the movable blade 80B is reciprocated in the vertical direction by a cutting motor 80C including a DC motor and the like. Thus, the roll sheet 3A with print performed by the above described thermal head 32 is cut into to a desired length with the stationary blade 80A and movable blade 80B to generate a print label, which is then discharged from the sheet discharging port 6A.

On the other hand, a control board 40, a power source board 41, a battery storage part (not illustrated) for storing a battery BT describe later, and the like are disposed under the roll storage part 4. A control circuit 210 (see FIG. 6 described later) for driving and controlling each mechanical part such as the thermal head 32 under an instruction from an external personal computer or the like is arranged in the above described control board 40. The above described sheet discriminating sensors P1-P5 are electrically connected to the above described control board 40. A power source circuit 211A (see FIG. 6 described later) is arranged in the above described power source board 41.

<Control System of Label Producing Apparatus>

Next, a control system of the print label producing apparatus 1 will be explained using FIG. 6.

In FIG. 6, the print label producing apparatus 1 includes the above described platen roller 35 for feeding the roll sheet 3A to the above described sheet discharging port 6A and discharging the same therefrom; a platen roller driving circuit 209 for controlling a platen-roller motor 208 for driving the above described platen roller 35; a print-head driving circuit 205 for controlling the energization of the above described heating element of the thermal head 32; a cutting driving circuit 206 for controlling the cutting motor 80C for driving the above described cutter unit 80; and a control circuit 210 for controlling the whole operation of the print label producing apparatus 1 via the above described print-head driving circuit 205, platen roller driving circuit 209, cutting driving circuit 206, and the like.

The control circuit 210 is the so-called microcomputer, and includes, though the detailed illustration is omitted, a CPU which is a central processing unit, and a memory 210A including a ROM and a RAM. The control circuit 210 performs, in accordance with a program (including a program for executing a control procedure of FIG. 8, FIG. 10, and FIG. 14 described later) stored in advance in the ROM, signal processing while using a temporary storage function of the RAM. Moreover, the control circuit 210 is connected to the above described display part 8 and operation part 7, and to a communication circuit 211B. The control circuit 210 is connected to an appropriate communication line via the communication circuit 211B, so that it is capable of exchanging information among a non-illustrated route server, another terminal, general-purpose computer, information server, and the like connected to this communication line, The control circuit 210 is connected to the power source circuit 211A. This power source circuit 211A is connected to the AC adapter 207 to be connected to an external power source, and turns on/off the power source of the print label producing apparatus 1. Moreover, at this time, the control circuit 210 includes an A/D input circuit 219 for measuring (detecting) the output voltage value of the battery BT stored in the above described battery storage part, the A/D input circuit 219 being connected to the battery BT (e.g., lithium ion rechargeable battery). Thus, either of the power feeding by an external power source via the AC adapter 207 or the power feeding by the above described battery BT can be selectively performed on the above described platen roller driving circuit 209, print-head driving circuit 205, and cutting driving circuit 206. Note that, in this example, in the case that the power source circuit 211A is connected to an external power source via the above described power source cord 11 and AC adapter 207 in a state where the battery BT is stored in the above described battery storage part, the power feeding by the external power source is automatically selected by a known approach, while in the case that the connection to an external power source has been eliminated (in a case where the power source cord 11 and/or AC adapter 207 have been pulled out, for example) power feeding is automatically switched to the power feeding by the battery by a known approach.

Note that a head-temperature sensor 110 disposed on the thermal head 35 and configured to detect the temperature of this thermal head 35 is also connected to the control circuit 210A.

On the other hand, as illustrated in FIG. 6, in the above described roll sheet 3A wound around the roll 3, the above described thermal layer 3*c* side of each label mount S serves, as previously described, as a print area in which a print R is formed by the thermal head 32. At this time, on the above described thermal layer 3*c* side of each label mount S, a substantially rectangular half-cutting line HC is formed for peeling off, from the separation sheet 3*a*, each label mount S with print. That is, the desired above-described print R based on printing data is formed (printed) in each label mount S surrounded by the half-cutting line HC. The roll sheet 3A with the print R is cut in the cutter unit 80 by the cut button 7B operated as described above, thereby generating a print label.

<Control of Energization of Thermal Head>

Here, the control of energization of the thermal head 32 by the print-head driving circuit 205 will be explained in detail. The thermal head 32 includes the above described plurality of heating elements (not illustrated) arranged in a direction perpendicular to the feed direction. These plurality of heating elements form the print R by forming dots corresponding to the above described print data on each print line of the roll sheet 3A. Specifically, the above described CPU of the above described control circuit 210 generates, from for example character string information acquired by the operation of a user (operator) via the above described operation part 7, the above described print data for forming dots with the heating elements. That is, the CPU generates, on the basis of an input character string and a dot pattern stored in advance in a CG-ROM or the like (not illustrated) inside the above described ROM, print data to be printed (image data including data in the unit of dots) and further divides this print data into the unit of one line which is printed by the above described heating elements disposed in a row in thermal head 32. For example, in a case where the print resolution is set to 360 dpi, line print data divided into 360 lines per inch is generated. Then, the above described print-head driving circuit 205 supplies, on the basis of the above described line print data from the CPU, a drive signal to the thermal head 32 to control the driving behavior of the thermal head 32. That is, after writing the above described line print data into a data register corresponding to each heating element, the print-head driving circuit 205 controls, on the basis of a strobe signal, the time and cycle of the energization of each heating element, thereby controlling the overall heating behavior of the thermal head 32.

Here, the process of forming dots on each print line of the roll sheet 3A by energization to the thermal head 32 will be described in detail. Here, the print line is a line, on which a row of dots are formed in the width direction of the roll sheet 3A by a row of heating elements which are energized for one print cycle. There is the print line at each interval obtained by dividing a unit length in the feed direction of the roll sheet 3A by resolution. Moreover, one print cycle corresponds to the time required for forming a row of dots in the width direction of the roll sheet 3A. Note that the length of one print cycle varies with the resolution and the feeding speed of the tape 103 and the like. For example, one print cycle in printing with 360 dpi at 40 mm/s is the time (e.g., about 1.8 ms) required to travel, at 40 mm/s, the distance (e.g., approximately 0.07 mm) between print lines of 360 dpi.

Accordingly, in forming one row of dots in the width direction of the roll sheet 3A, one print line of print data generated by the CPU is transferred to the thermal head 32, and corresponding heating elements are energized on the basis of the transferred one print line of print data. One print line of print data is the print data required for one row of dots to be formed in the width direction of the roll sheet 3A by a row of heating elements which are energized for one print cycle. Accordingly, the heating elements energized on the basis of one print line of print data are heated up to a coloring temperature required for the above described thermal layer 3*c* to generate a color. As the results, a portion, of the thermal layer 3*c*, in contact with the thermal head 32 generates a color due to the heating of heating elements, and one print line of dots are formed on the roll sheet 3A. Then, the above described heat-coloring process is repeatedly performed for each one print line while feeding the roll sheet 3A at a desired feeding speed. A large number of heating elements arranged on the thermal head 32 are, in each time, selectively and intermittently energized on the basis of each print line of print data transferred from the CPU. As the results, a dot image (text character etc.) desired by a user corresponding to the above described operation of the user via the above described operation part 7 is formed on the roll sheet 3A as the print R.

In the above described manner, in response to a print line, of the roll sheet 3A, which sequentially passes through the position of a heating element as the roll sheet 3A is fed, the energization behavior of the heating element is sequentially switched for each line print data. Thus, the thermal head 32 can print at a printing cycle (in other words, printing speed) matching the feeding speed of the roll sheet 3A.

Once printing of the above described dot pattern data ends, then feeding of the roll sheet 3A is stopped, and the cutting motor 80C is driven via the cutting driving circuit 206 in response to the operation of the above described cut button 7B, so that the roll sheet 3A is cut by the cutter unit 80 to generate a print label. In the generated print label, the label mount S is peeled off from the separation sheet 3*a* via the above described half-cutting line HC and is adhered to an adherend by an adhesive layer on the back surface of each label mount S.

<Temperature Effect on Roll Sheet>

Here, for example, in cases where the above described print label producing apparatus 1 and/or roll sheet 3A is used in various temperature environments (including, for example, a case where the roll sheet 3A is kept in another temperature environment while being detached from the print label producing apparatus 1), the above described printing speed is affected by this temperature. For example, in a case where the roll sheet 3A is at a relatively low temperature, the feeding resistance will increase, so it is necessary to set the above described printing speed to be relatively slow. This is because otherwise a degradation in print quality due to inappropriate feeding will occur, and/or in particular in a case where a pulse motor is used as the above described platen-roller motor 208, loss of synchronization may occur. In contrast, in a case where the roll sheet 3A is at a relatively high temperature, the feeding resistance will decrease, so the above described printing speed can be set to be relatively high. However, once the roll 3, around which the above described roll sheet 3A is wound, is set on the print label producing apparatus 1, it is difficult for the print label producing apparatus 1 side to accurately detect the temperature of the roll sheet 3A, and therefore in this case it is difficult to precisely and appropriately determine the above described printing speed.

Then, in this embodiment, feeding is performed without energization to the heating element of the above described thermal head 32 (non-energization feeding is performed). In performing this non-energization feeding, the thermal head 32 is in contact with the roll sheet 3A to be fed, so due to heat conduction the temperature of the thermal head 32 (hereinafter, referred to as the "head temperature" as needed) will approach the temperature of the roll sheet 3A (hereinafter, referred to as the "medium temperature" as needed) with time (i.e., the temperature of the thermal head 32 and the temperature of the roll sheet 3A will approach each other).

That is, for example, as illustrated in FIG. 7A, in the case that the above described head temperature is at a relatively low temperature and the above described medium temperature is at a high temperature, the head temperature T is a relatively low temperature T1 at a time t1 immediately after starting the non-energization feeding (time t=0). However, due to the above described heat conduction, the head temperature T slightly rises to T2 at time t2, and then further steeply rises to T3 at time t3. Then, the degree of this rising of the above described head temperature gradually decreases as approaching the medium temperature, and the head temperature T becomes T4 at time t4 and then becomes T5 at time t5. Further, at time t6, the head temperature T becomes T6 with almost no deviation from the above described T5 (see head temperature deviations ΔTA−ΔTE and the like described later), in other words T6 which can be regarded as substantially equal to the medium temperature.

In contrast, as illustrated in FIG. 7B, in the case that the above described head temperature is at a relatively high temperature and the above described medium temperature is at a low temperature, the head temperature T is a relatively high temperature T11 at a time t1 immediately after starting the non-energization feeding (time t=0). However, due to the above described heat conduction, the head temperature T slightly drops to T12 at time t2, and then further drops to T13 at time t3, and then steeply drops to T14 at time t4. The degree of this dropping of the above described head temperature gradually decreases as approaching the medium temperature, and then the above described head temperature becomes T4 at the above described time t4. Then, the head temperature T becomes T15 at time t5, and then at time t6 the head temperature T becomes T16 with almost no deviation from the above described T15 (see head temperature deviations ΔTP−ΔTT and the like described later), in other words T16 which can be regarded as substantially equal to the medium temperature.

In this embodiment, the above described printing speed is determined on the basis of a state where the head temperature becomes substantially equal to the medium temperature as described above (in other words, on the basis of the fact that the above described deviation becomes sufficiently small). Hereinafter, the details of this procedure will be explained step by step.

<Control Procedure>

A control procedure which the above described CPU of the control circuit 210 performs in order to realize the above described approach will be explained using FIG. 8 and FIG. 10.

A flow illustrated in FIG. 8 is started, for example, by a user who issues a print start instruction via an appropriate operation in the above described operation part 7, another terminal, the general-purpose computer, or the like. First, in step S5, the CPU performs the initialization of various types of counters, including a process of setting the value of a constant-temperature detection counter described later to zero.

Then, in step S10, the CPU outputs a control signal to the platen roller driving circuit 209 to cause the above described platen-roller motor 208 to drive the platen roller 35, thereby starting a predetermined amount of feeding of the roll sheet 3A. In this case, the energization to the heating element of the above described thermal head 32 via the print-head driving circuit 205 is not performed (i.e., non-energization feeding).

Then, transitioning to step S15, where the above described CPU acquires the above described head temperature detected by the above described head temperature sensor 110. Note that, in this view, this head temperature is denoted as a head temperature (1) in order to discriminate from the head temperature acquired in step S25 described later.

Then, in step S20, the above described CPU outputs a control signal to the platen roller driving circuit 209 to stop the driving of the platen roller 35 performed by the above described platen-roller motor 208, thereby ending a specific amount of non-energization feeding which was started in the above described step S10. For the determination of the feeding amount at this time, for example the fed distance from a certain reference position may be determined using a predetermined known method (e.g., the number of pulses output by the above described platen roller driving circuit 209 for driving the above described platen-roller motor 208 of the stepping motor may be counted). Alternatively, an appropriate identification mark (a mark M of a second embodiment described later may be applicable) disposed on the above described roll sheet 3A may be detected with a known sensor separately disposed.

Then, transitioning to step S25, where the above described CPU acquires, at this timing, again the above described head temperature detected by the above described head temperature sensor 110. Moreover, in this view, this head temperature is denoted as a head temperature (2) in order to discriminate from the head temperature acquired in step S15 described above.

Then, in step S30, the above described CPU subtracts the head temperature acquired in the above described step S15 from the head temperature acquired in the above described step S25 to calculate the head temperature deviation ΔT (see, ΔTA−ΔTE, ΔTP−ΔTT, and the like which are described later using FIG. 7A and FIG. 7B).

Then, in step S35, the above described CPU determines whether or not the head temperature deviation calculated in the above described step S30 satisfies ΔT>0.

<During Rising of Head Temperature>

In a case where ΔT>0 in the above described step S35 (i.e., in a case where the above described medium temperature is greater than the above described head temperature and the above described head temperature tends to rise with time: see FIG. 7A described above), the determination is satisfied (S35: Yes) and the flow transitions to step S40.

In step S40, the above described CPU determines whether or not an absolute value |ΔT| of the head temperature deviation ΔT calculated in the above described step S30 is equal to or greater than a predetermined threshold (in other words, whether or not the temperature tends to rise to a certain or further extent). For example, in FIG. 7A, the head temperature deviation ΔTA=T2−T1 when the head temperature becomes T1→T2 at time t1→t2 immediately after the above described non-energization feeding is started becomes less than this threshold and does not satisfy the above described determination (S40: No), so the flow transitions to step S60.

In step S60, after the above described CPU increments the constant-temperature detection counter for counting the duration time of a state where the head temperature is substantially constant, the flow transitions to step S65.

In step S65, the above described CPU determines whether or not the count value of the above described constant-temperature detection counter is equal to or greater than a predetermined number (in other words, whether or not a state where the head temperature is substantially constant has continued for a sufficiently long time). While the state where the head temperature is substantially constant has not yet continued and the count value of the above described constant-temperature detection counter is less than the above described predetermined number, the determination of step S65 is not satisfied and the flow returns to the above described step S10. Then, while the determination of step S65 is not satisfied as described above, the flow from step S10-step S30→step S35→step S40→step S60→step S65→step S10→ . . . will be repeated.

During this repetition, as described above in the flow from step S15 (e.g., acquire head temperature T2)→step S20→step S25 (e.g., acquire head temperature T3)→step S30→step S35, if the rising degree of the head temperature increases, and the absolute value of the head temperature deviation ΔTB=T3−T2 when the above described head temperature becomes T2→T3 at time t2→t3 in FIG. 7A becomes equal to or greater than the above described threshold, then the determination of step S40 is satisfied (S40: Yes) and the flow transitions to step S45.

In step S45, the above described CPU temporarily determines a higher temperature (in this example, the head temperature acquired in the above described step S25) among the head temperature acquired in the above described step S25 and the head temperature acquired in the above described step S15, as the medium temperature for determining the above described printing speed in step S75 described later. Then, the flow transitions to step S47.

In step S47, after the above described CPU initializes the above described constant-temperature detection counter to zero, the flow transitions to the above described step S65. In step S65, the determination is not satisfied due to the above described initialization, so the flow returns to the above described step S10. Then, while the rising degree of the head temperature has a certain or higher level as described above and the determination of step S40 is satisfied (e.g., in FIG. 7A, in a case where the absolute value of the head temperature deviation ΔTC=T4−T3 when the above described head temperature becomes T3→T4 at time t3→t4 and the absolute value of the head temperature deviation ΔTD=T5−T4 when the above described head temperature becomes T4→T5 at time t4→t5 become equal to or greater than the above described threshold), the flow from step S10-step S30→step S35→step S40→step S45→step S47→step S65→step S10→ . . . is repeated. In step S45 in each time, the latest value on the higher temperature side of the above described head temperature tending to rise is temporarily determined as the above described medium temperature (in the form of being sequentially overwritten and updated).

During this repetition, as described above in the flow from step S15 (e.g., acquire head temperature T5)→step S20→step S25 (e.g., acquire head temperature T6)→step S30→step S35, if the absolute value of the head temperature deviation ΔTE=T6−T5 when the above described head temperature becomes T5→T6 at time t5→t6 in FIG. 7A becomes less than the above described threshold, then the determination of step S40 is not satisfied (S40: No), so the flow again transitions to step S60, where the constant-temperature detection counter (which is already initialized to zero as described above) is resumed to be incremented.

While the number of times of increment in step S60 is low and the determination of step S65 is not satisfied, immediately after the rising degree of the head temperature becomes low as described above (e.g., in FIG. 7A, immediately after the above described head temperature deviation ΔTE=T6−T5 at time t5→t6), the flow from step S10-step S30→step S35→step S40→step S60→step S65→step S10→ . . . is repeated and in step S60 in each time, the value of the above described constant-temperature detection counter will gradually increase.

During this repetition, as described above in the flow from step S15 (acquire head temperature T)→step S20→step S25 (e.g., acquire head temperature T)→step S30→step S35, e.g., as with at time t6 and thereafter in FIG. 7A, if a state continues where the head temperature deviation ΔT is sufficiently small, and due to a gradual increase in the above described constant-temperature detection counter in step S60 the value thereof becomes equal to or greater than the above described predetermined number, then the determination of step S65 is satisfied (S65: Yes) and the flow transitions to step S70.

In step S70, the above described CPU determines the medium temperature temporarily determined in the above described step S45 at this point (the head temperature which tends to rise and which is sequentially overwritten and updated as described above, i.e., the latest and highest value of the head temperature), as the final medium temperature.

<During Dropping of Head Temperature>

On the other hand, in a case of ΔT≤0 in the above described step S35 (i.e., in a case where the above described medium temperature is equal to or less than the above described head temperature and the above described head temperature tends to drop with time: see above describe FIG. 7 B), the determination is not satisfied (S35: No) and the flow transitions to step S50.

In step S50, the above described CPU determines whether or not an absolute value |ΔT| of the head temperature deviation ΔT calculated in the above described step S30 is equal to or greater than a predetermined threshold (in other words, whether or not the temperature tends to drop to a certain or further extent). For example, in FIG. 7 B, the absolute value of the head temperature deviation ΔTP=T12−T11 when the head temperature becomes T11→T12 at time t1→t2 immediately after the above described non-energization feeding is started becomes less than this threshold and the above described determination is not satisfied (S50: No), so the flow transitions to the above described step S60, where the constant-temperature detection counter is incremented as described above. Then, the flow transitions to step S65.

In step S65, as previously described, while the state where the head temperature is substantially constant has not yet continued and the count value of the above described constant-temperature detection counter is less than the above described predetermined number, the determination of step S65 is not satisfied and the flow returns to the above described step S10. While the determination of this step S65 is not satisfied, the flow from step S10-step S30→step S35→step S50→step S60→step S65→step S10→ . . . is repeated.

During this repetition, as described above in the flow from step S15 (e.g., acquire head temperature T12)→step S20→step S25 (e.g., acquire head temperature T13)→step S30→step S35, if the dropping degree of the head temperature increases, and the absolute value of the head temperature deviation ΔTQ=T13−T12 when the above described head temperature becomes T12→T13 at time t2→t3 in FIG. 7B becomes equal to or greater than the above described threshold, then the determination of step S50 is satisfied (S50: Yes) and the flow transitions to step S55.

In step S55, the above described CPU temporarily determines a lower temperature (in this example, the head temperature acquired in the above described step S25) among the head temperature acquired in the above described step S25 and the head temperature acquired in the above described step S15 as the medium temperature for determining the above described printing speed in step S75 described later. Then, the flow transitions to step S57.

In step S57, after the above described CPU initializes the above described constant-temperature detection counter to zero, the flow transitions to the above described step S65. In step S65, the determination is not satisfied due to the above described initialization, so the flow returns to the above described step S10. Then, while the dropping degree of the head temperature has a certain or higher level as described above and the determination of step S40 is satisfied (e.g., in FIG. 7B, in a case where the absolute value of the head temperature deviation ΔTR=T14−T13 when the above described head temperature becomes T13→T14 at time t3→t4, and the absolute value of the head temperature deviation ΔTS=T15−T14 when the above described head temperature becomes T14→T15 at time t4→t5 become equal to or greater than the above described threshold), the flow from step S10-step S30→step S35→step S50→step S55→step S57→step S65→step S10→ . . . is repeated. In step S55 in each time, the latest value on the lower temperature side of the above described head temperature tending to drop is temporarily determined as the above described medium temperature (in the form of being sequentially overwritten and updated).

During this repetition, as described above in the flow from step S15 (e.g., acquire head temperature T15)→step S20→step S25 (e.g., acquire head temperature T16)→step S30→step S35, if the absolute value of the head temperature deviation ΔTT=T16−T15 when the above described head temperature becomes T15→T16 at time t5→t6 in FIG. 7B becomes less than the above described threshold, then the determination of step S50 is not satisfied (S50: No) and the flow transitions again to step S60, where the constant-temperature detection counter (already initialized to zero as described above) is resumed to be incremented.

Then, while the number of times of increment in step S60 is low and the determination of step S65 is not satisfied immediately after the dropping degree of the head temperature becomes low as described above (e.g., in FIG. 7B, immediately after the above described head temperature deviation ΔTT=T16−T15 at time t5→t6), the flow from step S10-step S30→step S35→step S50→step S60→step S65→step S10→ . . . is repeated, and in step S60 in each time, the value of the above described constant-temperature detection counter will gradually increase.

During this repetition, as described above in the flow from step S15 (acquire head temperature T)→step S20→step S25 (e.g., acquire head temperature T)→step S30→step S35, for example, as with at time t6 and thereafter in FIG. 7B, if a state continues where the head temperature deviation ΔT is sufficiently small, and due to a gradual increase in the above described constant-temperature detection counter in step S60, the value thereof becomes equal to or greater than the above described predetermined number, then the determination of step S65 is satisfied (S65: Yes) and the flow transitions to step S70.

In step S70, the above described CPU determines the medium temperature temporarily determined in the above described step S55 at this point (the head temperature which tends to drop and which is sequentially overwritten and updated as described above, i.e., the latest and lowest value of the head temperature) as the final medium temperature.

<Determination of Printing Speed>

Once the final medium temperature is determined in step S70 as described above, the flow transitions to step S75. In step S75, with reference to a medium temperature-printing speed table (see FIG. 9) on which a correlation between the medium temperature and the printing speed is recorded, the table being stored in advance in the above described memory 210A, the above described CPU determines the above described printing speed corresponding to the medium temperature determined in the above described step S70. In this table, as illustrated the medium temperature and the printing speed are set in advance so that the lower the medium temperature, the slower the printing speed becomes while the higher the medium temperature, the faster the printing speed becomes. As illustrated, in a typical example, for example, the printing speed Vb≅85 [mm/sec] in a zone in which the medium temperature is equal to or greater than 12 [° C.] and is less than 17 [° C.], and the printing speed Vc≅96 [mm/sec] in a zone in which the medium temperature is equal to or greater than 17 [° C.] and is less than 22 [° C.]. Then, the flow transitions to step S80 in FIG. 10.

<Print Control>

Once the printing speed is determined in step S75 in the above described manner, then in step S80-step S125 illustrated in FIG. 10, the printing process at the above described printing speed is executed. That is, in step S80, the above described CPU outputs a control signal to the platen roller driving circuit 209 to cause the above described platen-roller motor 208 to drive the platen roller 35 and start again feeding the roll sheet 3A.

Then, the flow transitions to step S85, where the above described CPU determines, with a known approach, whether or not the position in the feed direction of the roll sheet 3A has reached a desired print start position in the above described print area. Until the position in the feed direction of the roll sheet 3A reaches the print start position, the determination of step S85 is not satisfied (S85: NO), so this program waits in the loop. If it reaches the print start position, the determination of step S85 is satisfied (S85: YES), so the flow transitions to step S90.

In step S90, the above described CPU outputs a control signal to the print-head driving circuit 205 to energize the heating element of the above described thermal head 32, thereby performing the print using the above described print data onto the roll sheet 3A.

Then, in step S95, the above described CPU determines, with a known approach, whether or not the position in the feed direction of the roll sheet 3A has reached a desired print end position in the above described print area. Until it reaches the print end position, the determination of step S95 is not satisfied (S95: NO) and the flow returns to step S90 and the similar procedure will be repeated. If the position in the feed direction of the roll sheet 3A has reached the print end position, the determination of step S95 is satisfied (S95: YES), so the flow transitions to step S110.

In step S110, the above described CPU outputs a control signal to the print-head driving circuit 205 to stop energizing the heating element of the above described thermal head 32 and end the printing to the roll sheet 3A which was started in the above described step S90.

Then, the flow transitions to step S115, where the above described CPU determines, with a known approach, whether or not the position in the feed direction of the roll sheet 3A has reached a tape cut position (whether or not the above described stationary blade 80A and movable blade 80B have faced a predetermined cut portion located on the upstream side in the feeding direction of the above described print area). Until it reaches the tape cut position, the determination of step S115 is not satisfied (S115: NO), so this program waits in the loop. If the position in the feed direction of the roll sheet 3A has reached the tape cut position, the determination of step S115 is satisfied (S115: YES), so the flow transitions to step S120.

In step S120, the above described CPU outputs a control signal to the platen roller driving circuit 209 to stop the driving of the platen roller 35 performed by the above described platen-roller motor 208 and stop feeding the roll sheet 3A.

Then, in step S125, the CPU outputs a control signal to the cutting driving circuit 206 in response to the operation of the cut button 7B by a user to drive the cutting motor 80C, thereby causing the above described movable blade 80B of the cutter unit 80 to cut the roll sheet 3A with print. Thus, a print label with print corresponding to the above described print data is generated.

Advantages of First Embodiment

As explained above, according to this embodiment, non-energization feeding is performed without energization to the heating element of the thermal head 32. In this non-energization feeding, due to heat conduction the head temperature of the thermal head 32 will approach the temperature of the roll sheet 3A with time. In response to this, the above described head temperature is detected at each of two different timings during the above described non-energization feeding (see the above described step S15 and step S25), and the head temperature deviation ΔT which is the difference therebetween is calculated (see the above described step S30). Then, the printing speed is determined on the basis of this head temperature deviation ΔT. Specifically, when the above described head temperature deviation ΔT becomes sufficiently small and the above described head temperature to be detected becomes substantially equal to the above described medium temperature of the roll sheet 3A which is the print-receiving medium, the printing speed is appropriately determined in accordance with this temperature. As the result, unlike the prior art which does not particularly take into consideration the temperature of a print-receiving medium, it is possible to respond to a change in the feeding resistance of the roll sheet 3A due to a change in temperature and to precisely set an appropriate printing speed. Moreover, in this case, disposing of one head temperature sensor 110 is sufficient as a detecting device, so the cost will not be increased.

Moreover, in this embodiment, in particular, the above described temperature-printing speed table is stored in the memory 210A in advance, so the printing speed corresponding to the above described medium temperature is determined with reference to this table (see step S75). In this manner, with reference to the above described correlation of the preset and stored table, the printing speed can be determined promptly and under a simple control.

Moreover, in this embodiment, in particular, triggered by the determination that the above described head temperature deviation ΔT falls within a predetermined value (the case of No in step S40 or step S50), the detected latest head temperature is determined as the medium temperature. Thus, when the above described head temperature deviation ΔT falls within the predetermined value, the head temperature is regarded as substantially equal to the above described medium temperature, and an appropriate printing speed can be set on the basis of this head temperature.

Moreover, in this embodiment, in particular, in the case that it is determines that the determination state where "the above described head temperature deviation ΔT falls within a predetermined value" has continued for a predetermined time or for over the predetermined time (see step S65), the latest head temperature is determined as the above described medium temperature. Thus, the fact can be detected that the head temperature becomes certainly equal to the above described medium temperature, and an appropriate printing speed can be securely set on the basis of this head temperature.

Note that, the above describe first embodiment is not limited to the above described one, but various variations are possible without departing from the scope and spirit and technical ideas thereof. For example, instead of temporally and continuously calculating the head temperature deviation ΔT until it becomes sufficiently small as described above, and then determining the medium temperature with this head temperature, the medium temperature may be predicted using a reduced behavior of the head temperature deviation ΔT and the medium temperature may be determined in accordance with this prediction.

That is, as illustrated in FIG. 11A, FIG. 11B each corresponding to above described FIG. 7A, FIG. 7B, in this modification example, using the head temperature deviation ΔT (in this example, the above described head temperature deviations ΔTA, ΔTB and ΔTP, ΔTQ each being based on the head temperatures T1, T2, T3 and T11, T12, T13) which is chronologically and sequentially calculated by the above described CPU as described above, the behavior of the head temperature change thereafter is estimated. Then, on the basis of the above described estimated change in behavior (see two-dot chain lines), a predicted value (e.g., equal to Te1, Te2 as illustrated) of the above described medium temperature when the above described head temperature deviation ΔT falls within the above described (sufficiently small) predetermined value is determined. Then, as with the above described embodiment, with reference to the above described table stored in the above described memory 210A, the printing speed corresponding to the determined predicted-value of the medium temperature is determined by the CPU. Note that, the above described estimation and prediction can be also performed using not both but either one of the above described head temperature deviations ΔTA, ΔTB (alternatively, not both but either one of the above described head temperature deviations ΔTP, ΔTQ).

In this variant, unlike the above described first embodiment, even without necessarily having to chronologically and sequentially calculate the head temperature deviation ΔT, a timing is predicted, at which a head temperature estimated on the basis of the head temperature deviation ΔT at a certain time point sufficiently approaches the medium temperature, and then an appropriate printing speed can be set in accordance with the predicted value of this medium temperature at this time.

Next, a second embodiment of the present disclosure will be explained with reference to FIG. 12-FIG. 14. The same reference numeral is given to the part equivalent to the first embodiment to omit or simplify the description thereof as needed.

In this embodiment, the printing speed is determined in accordance with the magnitude of the actual feeding amount of the roll sheet 3A in the print label producing apparatus 1 when a desired feeding amount of feeding (hereinafter, referred to as a "specified feeding amount" as needed) is specified. That is, for example, in a case where the roll sheet 3A is at a relatively low temperature, the feeding resistance will increase, so the above described actual feeding amount becomes smaller than the above described specified feeding amount. In contrast, in a case where the roll sheet 3A is at a relatively high temperature, the feeding resistance will decrease, so the above described actual feeding amount becomes larger than the above described specified feeding amount. In this embodiment, the above described printing speed is determined utilizing such a behavior.

A functional block diagram representing the control system of a print label producing apparatus in this embodiment is illustrated in FIG. 12 corresponding to the above described FIG. 6. In this FIG. 12, the print label producing apparatus 1 of this embodiment includes, in place of the head temperature sensor 110 illustrated in FIG. 6, an atmospheric temperature sensor 220 which is disposed inside the housing 2 of the print label producing apparatus 1 and detects the atmospheric temperature therearound.

At this time, in this embodiment, as illustrated in the above described FIG. 12, and further FIG. 13A (illustrating an image after formation of the print R) and FIG. 13B, a large number of marks M are formed at a known interval in the surface (on the opposite side of the thermal layer 3*c*) of the separation sheet 3*a* in the roll sheet 3A. These marks M are detected by a newly disposed optical sensor 230 (see FIG. 12), and on the basis of this detection result, the actual feeding amount of the roll sheet 3A is calculated (the details will be described later).

<Control Procedure>

A control procedure which the above described CPU of the control circuit 210 in this embodiment performs in order to realize the above described approach will be explained using FIG. 14.

This flow illustrated in FIG. 14 is started, for example, by a user who issues a print start instruction through appropriate operations in the above described operation part 7, another terminal, the general-purpose computer, or the like. First, in step S210, the above described CPU acquires the above described atmospheric temperature detected by the above described atmospheric temperature sensor 220.

Then, the above described CPU temporarily determines the atmospheric temperature acquired in the above described step S210 as the medium temperature for determining the above described printing speed in step S215 described later similar to the above described first embodiment. Then, the flow transitions to step S217.

In step S217, the above described CPU receives a feeding length (hereinafter, referred to as a "specified feeding amount" as needed) which a user specifies, for example, via the operation part 7, such as the above described feed button 7C.

Then, in step S220, the above described CPU outputs a control signal to the platen roller driving circuit 209 to forwardly rotate the above described platen-roller motor 208 and drive the platen roller 35, thereby starting the above described specified feeding amount of feeding in the forward direction of the roll sheet 3A.

Then, in step S225, the above described CPU ends the above described specified feeding amount of feeding which was started in the above described step S220. The feeding amount determination at this time is performed, for example, by counting the number of pulses output from the above described platen roller driving circuit 209 for driving the above described platen-roller motor 208 of the stepping motor.

Then, in step S230, the above described CPU outputs a control signal to the platen roller driving circuit 209 to reversely rotate the above described platen-roller motor 208 and drive the platen roller 35 in a direction opposite to the above described direction, thereby starting the feeding of the above described roll sheet 3A (in a direction opposite to the above described forward direction).

Then, in step S235, the above described CPU starts the counting of the above described mark M which is sequentially detected by the optical sensor 230 associated with the reverse rotation of the motor which was started in the above described step S230.

Then, in step S240, the above described CPU outputs a control signal to the platen roller driving circuit 209 to end the reverse rotation of the above described platen-roller motor 208, and then in the above described step S230 ends the feeding of the above described roll sheet 3A in the opposite direction. Note that, at this time, for example the above described number of pulses, which is used in order to drive the above described platen-roller motor 208 in the above described step S220-step S225, is counted. Then, the above described platen-roller motor 208 is reversely rotated by the same number of pulses as this number.

Then, in step S245, the above described CPU ends the counting of the above described mark M which was started in the above described step S235.

Then, transitioning to step S250, where the above described CPU calculates, on the basis of the number of the above described marks M which has been counted from the start of counting in the above described step S235 to the end of counting in the above described step S245, the actual feeding amount performed by the above described platen-roller motor 208 from the above described step S230 to the above described step S240 (this actual feeding amount results in a feeding amount corresponding to the specified feeding amount from step S220-step S225, according to the above described approach). Then, the flow transitions to step S255.

In step S255, the above described CPU determines whether or not the above described actual feeding amount calculated in the above described step S250 is equal to the specified feeding amount received in step S217.

In the case that the above described actual feeding amount is smaller than the above described specified feeding amount (in other words, the deviation obtained by subtracting the specified feeding amount from the actual feeding amount is negative) in the above described step S255, the flow transitions to step S260, where the above described CPU regards the driving torque of the platen-roller motor 208 in feeding in the above described forward direction as insufficient (i.e., the roll sheet 3A has a feeding resistance larger than predicted at a lower temperature), and corrects the medium temperature temporarily determined in the above described step S215 toward the minus side (e.g., by a predetermined amount), and determines the final medium temperature (determines a post-correction temperature). Then, the flow transitions to step S270 described later.

On the other hand, in the case that the above described actual feeding amount is larger than the above described specified feeding amount (in other words, the deviation obtained by subtracting the specified feeding amount from the actual feeding amount is positive) in the above described step S255, the flow transitions to step S265, where the above described CPU regards the driving torque of the platen-roller motor 208 in feeding in the above described forward direction as excessively large (i.e., the roll sheet 3A has a feeding resistance smaller at a higher temperature than predicted), and corrects the medium temperature temporarily determined in the above described step S215 toward the plus side (e.g., by a predetermined amount), and determines the final medium temperature (determines a post-correction temperature). Then, the flow transitions to step S270 described later.

Furthermore, in the case that the above described actual feeding amount is equal to the above described specified feeding amount (in other words, the deviation obtained by subtracting the specified feeding amount from the actual feeding amount is zero) in the above described step S255, the flow transitions to step S267, where the above described CPU regards the medium temperature temporarily determined in the above described step S215 as the final medium temperature as is without particularly making any correction to this medium temperature. Then, the flow transitions to step S270 described later.

In step S270, the above described CPU determines, as with the above described step S75 of the above described FIG. 8, with reference to a temperature-printing speed table (illustration thereof is omitted) on which a correlation between the medium temperature and the printing speed is recorded, the table being stored in advance in the above described memory 210A, the above described printing speed corresponding to the medium temperature finally determined in the above described step S260, step S265, and/or step S267. Although illustration is omitted, also in this table, the medium temperature and the printing speed are set in advance so that the lower the medium temperature, the slower the printing speed becomes while the higher the medium temperature, the faster the printing speed becomes. Note that the same table (see FIG. 9) as the above described first embodiment may be used.

After the above described step S270 ends, the flow transitions to the above described step S80 in FIG. 10. Hereinafter the flow is the same as that of the above described first embodiment, so the explanation is omitted.

Advantages of Second Embodiment

As explained above, according to this embodiment, the feeding of the roll sheet 3A corresponding to the above described specified feeding amount is performed (see step S230-step S240), and the actual feeding amount at this time is detected (see step S235-step S245). At this time, due to an increase in the feeding resistance due to a low temperature (or a reduction in the feeding resistance due to a high temperature) of the roll sheet 3A as described above, the above described actual feeding amount becomes smaller (or becomes larger) than the above described specified feeding amount. In this embodiment, in response to this, the above described printing speed is determined on the basis of the deviation of the above described actual feeding amount from the specified feeding amount (see step S260, step S265, step S267, and step S270). Thus, an appropriate printing speed corresponding to the temperature of the roll sheet 3A can be determined.

Moreover, in this embodiment, in particular, the feeding corresponding to the above described specified feeding amount is performed in the opposite direction (see the above described step S230-step S240). Thus, as previously described, through the flow from feeding in the forward direction in response to the reception of the input of the specified feeding amount (step S220-step S225)→feeding, by an identical feeding amount, back in the opposite direction, and the actual feeding amount is detected in the feeding in the opposite direction at this time (step S230-step S250) →appropriately set the printing speed and then print (step S270 and the subsequent step S80-step S125), an appropriate printing process can be executed without wasting the roll sheet 3A.

Moreover, in this embodiment, in particular, a post-correction temperature (final medium temperature) on the basis of the deviation of the actual feeding amount from the specified feeding amount is determined with respect to the atmospheric temperature detected by the above described atmospheric temperature sensor 220 (see step S260, step S265), and then with reference to the above described table stored in the above described memory 210A, a printing speed corresponding to the above described post-correction temperature is determined (see step S270). That is, the printing speed can be determined promptly and under a simple control by referring to the above described table which is set in advance and stored in the memory 210A.

Moreover, in this embodiment, in particular, in the case that the actual feeding amount is smaller than the specified feeding amount, a correction toward the minus side is made with respect to the above described temporarily determined medium temperature (in other words, atmospheric temperature) to determine the final medium temperature after correction (see step S260), while in the case that the actual feeding amount is smaller than the specified feeding amount, a correction toward the plus side is made with respect to the above described temporarily determined medium temperature (in other words, atmospheric temperature) to determine the final medium temperature after correction (see step S265). Thus, an appropriate printing speed can be reliably set in response to the magnitude of the feeding resistance originating from the temperature of the roll sheet 3A.

Note that, in the above, a printer is configured so as to form the print R using the thermal head 32 onto the thermal layer 3*c* of the roll sheet 3A fed out from the roll 3 around which the roll sheet 3A is wound, but the present disclosure is not limited to this printer. That is, the present disclosure may be applicable to, as another example of the printer, a print label producing apparatus configured to form a print label by transferring heat from the thermal head 32 to an appropriate print-receiving tape and forming a print (in this case, s transfer method using an ink ribbon may be used) and/or a printer configured to form or print an image or a letter onto a regular sheet (e.g., of A4, A3, B4, or B5 size) to be printed by transferring heat from a thermal head. Also in this case, the similar advantages can be obtained.

Note that, in the above, the arrows illustrated in each view of FIG. 6, FIG. 12, and the like are for illustrating an example of the flow of a signal, but not for limiting the flow direction of the signal.

Moreover, the flow charts illustrated in FIG. 8, FIG. 10, FIG. 14, and the like do not limit the present disclosure to the procedures illustrated in the above described flows, but a procedure may be added or deleted or the sequence of the procedure may be changed without departing from the scope and technical idea of the disclosure.

Moreover, other than the embodiments and modification examples described above, the procedures according to the above described embodiments and each modification example may be combined and used, as needed.

What is claimed is:

1. A printer comprising:

a feeder configured to feed a print-receiving medium at a desired feeding speed;

a thermal head including a plurality of heating elements;

an energizing device configured to energize said plurality of heating elements;

a driving device configured to drive said feeder;

a first temperature detecting device disposed on said thermal head and configured to detect a head temperature of said thermal head; and a controller, said controller performing:

a coordination control process for coordinating and controlling said energizing device and said driving device and for forming a print onto said print-receiving medium by said thermal head at a printing speed synchronized with said feeding speed;

a first feed control process for, in a state where said energizing device does not perform energization to said heating element, controlling said driving device to perform non-energization feeding while causing said thermal head to contact said print-receiving medium;

a temperature-difference calculation process for calculating, during execution of said non-energization feeding in said first feed control process, a first deviation between two of said head temperatures which are respectively detected by said first temperature detecting device at different timings; and a first printing speed determination process for determining said printing speed on the basis of said first deviation calculated in said temperature-difference calculation process.

2. A printer comprising:

a feeder configured to feed a print-receiving medium at a desired feeding speed;

a thermal head including a plurality of heating elements;

an energizing device configured to energize said plurality of heating elements;

a driving device configured to drive said feeder;

a first temperature detecting device disposed on said thermal head and configured to detect a head temperature of said thermal head; and a controller, said controller performing:

a coordination control process for coordinating and controlling said energizing device and said driving device and for forming a print onto said print-receiving medium by said thermal head at a printing speed synchronized with said feeding speed;

a first feed control process for, in a state where said energizing device does not perform energization to said heating element, controlling said driving device to perform non-energization feeding while causing said thermal head to contact said print-receiving medium;

a temperature-difference calculation process for calculating, during execution of said non-energization feeding in said first feed control process, a first deviation between two of said head temperatures which are respectively detected by said first temperature detecting device at different timings; and a first printing speed determination process for determining said printing speed on the basis of said first deviation calculated in said temperature-difference calculation process, wherein a first determination process for determining whether or not said first deviation chronologically and sequentially calculated in said temperature-difference calculation process on the basis of said head temperature chronologically and sequentially detected by said first temperature detecting device during execution of said non-energization feeding falls within a predetermined value, and wherein in said first printing speed determination process, triggered by a determination in said first determination process that said first deviation falls within said predetermined value, said head temperature which is a latest one detected by said first temperature detecting device is determined as a medium temperature of said print-receiving medium.

3. The printer according to claim 2, wherein:

said controller further performs a second determination process for determining whether or not a state, where it is determined in said first determination process that said first deviation falls within said predetermined value, has continued for a predetermined time or for over said predetermined time; and wherein in said first printing speed determination process, in the case that it is determined in said second determination process that a determination state where said first deviation in said first determination process falls within said predetermined value has continued for said predetermined time or for over said predetermined time, said latest head temperature is determined as said medium temperature.

4. The printer according to claim 2, further comprising a first memory that stores a first correlation between a medium temperature of said print-receiving medium and the printing speed, wherein in said first printing speed determination process, the medium temperature is determined on the basis of said first deviation calculated in said temperature-difference calculation process, and said printing speed corresponding to the determined medium temperature is determined with reference to said first correlation stored in said first memory.

5. The printer according to claim 4, wherein:

said controller further performs:

an estimation process for estimating a change behavior of said head temperature using said first deviation chronologically and sequentially calculated in said temperature-difference calculation process on the basis of said head temperature chronologically and sequentially detected by said first temperature detecting device during execution of said non-energization feeding; and a predicted-value determination process for determining, on the basis of said change behavior estimated in said estimation process, a predicted value of said medium temperature in the case that said first deviation falls within a predetermined value, and wherein in said first printing speed determination process, said printing speed corresponding to the determined predicted value is determined with reference to said first correlation stored in said first memory.

6. A printer comprising:

a feeder configured to feed a print-receiving medium at a desired feeding speed;

a thermal head including a plurality of heating elements;

an energizing device configured to energize said plurality of heating elements;

a driving device configured to drive said feeder;

a first temperature detecting device disposed on said thermal head and configured to detect a head temperature of said thermal head; and a controller, said controller performing:

a feed-starting process for controlling said driving device to perform feeding said print-receiving medium for a predetermined amount while causing said thermal head to contact said print-receiving medium;

a first head temperature acquisition process for acquiring a first head temperature detected by said first temperature detecting device during the feeding for said predetermined amount;

a second head temperature acquisition process for acquiring a second head temperature detected by said first temperature detecting device, on condition that the feeding is stopped after the feeding for said predetermined amount is finished;

a temperature-difference calculation process for calculating a first deviation between said first head temperature and said second head temperature;

a first printing speed determination process for determining a printing speed on the basis of said first deviation calculated in said temperature-difference calculation process; and a printing control process for coordinating and controlling said energizing device and said driving device and for forming a print onto said print-receiving medium by said thermal head at the printing speed synchronized with said feeding speed.

* * * * *